US010948183B2

(12) United States Patent
Ragnarsson

(10) Patent No.: US 10,948,183 B2
(45) Date of Patent: Mar. 16, 2021

(54) PORTABLE COMBUSTION SYSTEM WITH FIRST AND SECOND AIR SOURCES

(71) Applicant: RAGNAR ORIGINAL INNOVATION, INC., Hooksett, NH (US)

(72) Inventor: Anders Ragnarsson, Chester, NH (US)

(73) Assignee: TIGERCAT INDUSTRIES INC., Brantford (CA)

( * ) Notice: Subject to any disclaimer, the term of this patent is extended or adjusted under 35 U.S.C. 154(b) by 97 days.

(21) Appl. No.: 16/292,864

(22) Filed: Mar. 5, 2019

(65) Prior Publication Data

US 2019/0277495 A1 Sep. 12, 2019

Related U.S. Application Data

(60) Provisional application No. 62/639,253, filed on Mar. 6, 2018.

(51) Int. Cl.
*F23G 5/40* (2006.01)
*F23G 5/00* (2006.01)
(Continued)

(52) U.S. Cl.
CPC ..... *F23G 5/40* (2013.01); *F23G 5/002* (2013.01); *F23G 5/38* (2013.01); *F23G 5/444* (2013.01);
(Continued)

(58) Field of Classification Search
CPC ..... F23G 5/34; F23G 5/40; F23G 5/42; F23G 2203/60; F23G 2203/601
See application file for complete search history.

(56) References Cited

U.S. PATENT DOCUMENTS 3,371,629 A 3/1968 Engdahl et al.
3,682,115 A * 8/1972 Rodgers ..... F23G 5/40 110/222
(Continued)

FOREIGN PATENT DOCUMENTS

JP H04-86406 3/1992

OTHER PUBLICATIONS

Written Opinion filed in corresponding PCT Application No. PCT/US2019/020722 dated May 7, 2019.
(Continued)

*Primary Examiner* — David J Laux
(74) *Attorney, Agent, or Firm* — Davis & Bujold PLLC; Michael J. Bujold

(57) ABSTRACT

A combustion/carbonizing system which comprises a base frame and a combustion chamber frame which is pivotably attached to the base frame. The combustion chamber frame defines an open top combustion chamber having a bottom perforated plate. A plenum is formed below the perforated plate for collecting biochar which passes therethrough. A first source of combustion air is supplied across the top of the combustion chamber while a second source of combustion air passes through the perforated plate into the combustion chamber. The combustion/carbonizing system is capable of operating in a continuous manner for combustion wood or waste material to the desired degree required by the end user for the purpose of reducing the volume of the material as well as the associated emissions while generating valuable char and boichar as an end product. For some applications, the combustion/carbonizing system may be operated to combust completely the wood or waste material.

19 Claims, 17 Drawing Sheets

(51) Int. Cl.
*F23G 5/44* (2006.01)
*F23G 5/38* (2006.01)

(52) U.S. Cl.
CPC .... *F23G 2203/601* (2013.01); *F23G 2205/12* (2013.01); *F23G 2205/121* (2013.01)

(56) References Cited

U.S. PATENT DOCUMENTS 3,785,302 A * 1/1974 Davis ..... F23G 5/40 110/215
3,785,303 A * 1/1974 Hopkins ..... F23G 5/40 110/215
3,859,934 A * 1/1975 Weholt ..... F23G 5/40 110/203
4,627,365 A * 12/1986 Tseng ..... F23G 5/16 110/214
4,688,494 A * 8/1987 Domnitch ..... F23G 5/40 110/240
4,756,258 A * 7/1988 Gilbert ..... F23G 5/34 110/235
4,889,061 A * 12/1989 McPherson ..... F23G 5/34 110/336
5,050,509 A * 9/1991 Mormino ..... F23G 5/00 110/235
5,205,225 A * 4/1993 Milsap, III ..... B09C 1/06 110/110
5,315,938 A * 5/1994 Freller ..... F23G 5/40 110/233
5,415,113 A * 5/1995 Wheeler ..... F23G 5/40 110/241
5,743,196 A * 4/1998 Beryozkin ..... F23G 5/033 110/222
6,352,040 B1 * 3/2002 Voorhees ..... F23G 5/16 110/211
6,536,360 B2 * 3/2003 O'Connor ..... F23G 5/40 110/233
7,004,088 B2 * 2/2006 Ford ..... F23G 5/34 110/217
7,063,027 B2 * 6/2006 O'Connor ..... F23G 5/12 110/185
7,503,268 B2 * 3/2009 O'Connor ..... F23G 5/40 110/240
7,895,956 B2 * 3/2011 O'Connor ..... F23G 5/40 110/241
9,074,769 B2 * 7/2015 Suljak ..... F23J 13/08
2005/0115478 A1 * 6/2005 Pope ..... F23G 5/10 110/229
2007/0144412 A1 * 6/2007 O'Connor ..... F23G 5/40 110/241
2009/0211501 A1 * 8/2009 O'Connor ..... F23G 5/40 110/240
2011/0165524 A1 7/2011 Suljak et al.
2012/0235423 A1 * 9/2012 O'Connor ..... F23G 5/46 290/1 R
2018/0010043 A1 1/2018 Archuleta, Jr. et al.

OTHER PUBLICATIONS

International Search Report filed in corresponding PCT Application No. PCT/US2019/020722 dated May 7, 2019.

* cited by examiner

PORTABLE COMBUSTION SYSTEM WITH FIRST AND SECOND AIR SOURCES

FIELD OF THE INVENTION

The present invention relates to a portable combustion system provided which can readily be transported or repositioned to another location at the same job site, or to a new job site, has both first and second sources of air, and is designed to incinerate all types of vegetative waste, biomass, processed wood, chips, bark, ground wood, and other municipal solid waste (MSW), all of which is hereinafter referenced to as "waste material."

BACKGROUND OF THE INVENTION

Vegetative waste, in particular wood waste, has long been a difficult problem for community landfills, lumbering operations and cleanup operations after a natural disaster. Grinding wood waste reduces its volume, but is relatively expensive and can be harmful to the environment, and, in any event, it still fails to reduce the amount of wood waste. Moreover, in the context of a massive tree kill, due to insect infestation and/or climate change, for example, the approach of grinding, chipping and hauling the wood waste does not solve, but can actually spread the problem.

Fireboxes and fire pits have been used to burn vegetative waste at clearing sites. In order to reduce ash and smoke released during waste incineration (particulate release), a flow of high velocity air has been used to provide an "air curtain" over a fire pit or firebox in which the waste is burned. U.S. Pat. Nos. 4,756,258 and 5,415,113 describe portable apparatuses for air curtain incineration. The former patent relates to a fan and manifold assembly that can be towed to and positioned at the edge of a fire pit, whereas the latter patent relates to a firebox, fan, and manifold assembly mounted on a support frame for transport to a desired clearing site for incineration of waste without the need to dig a fire pit. These portable solutions offer relatively clean burning and also minimize the need to transport the waste, however, they both still suffer from a number of associated drawbacks.

It is to be appreciated that currently available fireboxes and fire pits are typically costly to move or transport from one job site to another job site. In addition, it is typically tedious and time-consuming to move a firebox or a fire pit from one location, on a job site, to another different location, on the same or a different job site. Lastly, the currently available fireboxes and fire pits typically require either a crane to lift the firebox or fire pit onto a trailer or require a very specialized trailer in order to facilitate transport of currently available fireboxes and fire pits from one job site or location to another job site or location. Further, such reposition often includes required assembly effort and time when arriving at a job site. This is a serious drawback concerning the currently available fireboxes and fire pits.

Trench burners tend to be somewhat easier to move, along a roadway, from one job site to another job site due their relatively compact size. However, trench burners typically require preparation work to be performed at the job site, such as digging a ditch in order to accommodate the trench burner.

In addition, the currently available trench burners, fireboxes and fire pits do not have any system for automatically removing the ash, char, biochar, clinkers, soot, unburnt debris, etc., which eventually accumulates within the combustion chamber while burning the vegetative waste and/or biomass. Accordingly, removal of the ash, char, biochar, clinkers, soot, unburnt debris, etc., tends to be a dirty, cumbersome, tedious, and time-consuming exercise.

Moreover, the currently available trench burners, fireboxes and fire pits typically lack an adequate supply of combustion air to the combustion chamber, particularly the lower portion of the combustion chamber. This lack of adequate combustion air inhibits efficient and substantially complete combustion of the vegetative waste and/or biomass when burnt within conventional burners, fireboxes and fire pits.

Further, the currently available trench burners, fireboxes and fire pits are typically not equipped with any automated or semi-automated ignition system which facilitates igniting the vegetative waste and/or biomass contained within the combustion chamber. Accordingly, one typical technique for commencing burning of the vegetative waste and/or biomass is to add an excessive amount of an accelerant, such as diesel fuel or some other readily combustible fuel, to the vegetative waste and/or biomass and then ignite the accelerant to commence combustion of the vegetative waste and/or biomass. Such technique is generally an inconvenient way of igniting the vegetative waste and/or biomass and may possibly create a potentially dangerous or hazardous situation.

Lastly, it is to be appreciated that the currently available trench burners, fireboxes and fire pits are not equipped with any automated feed mechanism for feeding additional waste material into the combustion chamber for consumption, as periodically required by the combustion chamber. In addition, none of the currently available trench burners, fireboxes and fire pits have any visual aid which assists an operator of the equipment with viewing combustion of the vegetative waste and/or biomass occurring within the combustion chamber.

Even with the recent advances which have occurred in the art, biomass incineration facilities and/or portable apparatuses still suffer from a number of associated drawbacks. Accordingly, there still remains a need for a vegetative waste and/or biomass incineration apparatus that can be easily setup at a temporary location and operated until the waste transportation costs become too high and, thereafter, the incineration apparatus can be easily moved or relocated to another location, either at the same job site or to a new job site for further incineration. The portable combustion system should not require any fuel(s) to supplement or augment burning process (other than the fuel required to commence ignition of the vegetative waste and/or biomass), and the portable combustion system should accept substantially 100% of the vegetative waste and/or biomass without any need to process the vegetative waste and/or biomass before the same is placed in the combustion chamber for combustion. Lastly, the portable combustion system should be designed to either periodically, or continuously, discharge of ash, char, biochar, clinkers, soot, unburnt debris, etc., from the combustion chamber so as to permit prolonged operation of the portable combustion system before any removal of ash, char, biochar, clinkers, soot, unburnt debris, etc., from the combustion chamber is required.

SUMMARY OF THE INVENTION

Wherefore, it is an object of the disclosure to overcome the above-mentioned shortcomings and drawbacks associated with the prior art incinerator apparatuses.

Another object is to provide a portable combustion system which can incinerate all types of vegetative waste and/or biomass, e.g., both unprocessed and processed waste material, and is readily a movable or repositionable from one location to another location, either at the same job site or at a new job site.

A further object is to provide a portable combustion system in which combustion air is supplied to the combustion chamber both from the top/side of the combustion chamber as well as from the bottom portion of the combustion chamber in order to increase and promote more efficient combustion of the waste material contained within the combustion chamber of the portable combustion system.

Yet another object is to preheat at least the second source of combustion air, being supplied to the bottom portion of the combustion chamber, prior to that combustion air passing through a plurality of openings formed in a perforated plate and entering into the combustion chamber so as to increase and promote more efficient combustion of the waste material contained within the combustion chamber of the portable combustion system.

A still further object is to provide the combustion chamber with at least one movable or slidable door or gate which permits periodic discharge of ash, char, biochar, clinkers, soot, unburnt debris, etc., from the combustion chamber and increases the duration of time that the portable combustion system can continuously operate before any emptying/servicing thereof is required. An alternative object is to provide an auger system, located vertically below a perforated plate provided at the bottom of the combustion chamber, which facilitates conveyance of the ash, char, biochar, clinkers, soot, unburnt debris, etc., which pass through the plurality of openings formed in the perforated plate, out of the portable combustion apparatus and thereby increases the duration of time that the portable combustion system can continuously operate before any emptying/servicing thereof is required or becomes necessary.

A further object is to provide a portable combustion system which can be readily disassembled into the base frame component and the combustion chamber frame component and each readily shipped within a respective conventional 40 foot shipping container. It is to be appreciated that in order for the base frame to fit readily within its 40 foot shipping container, the pair of tracks or the wheels (or possibly a set of stationary legs) are typically removed from a bottom portion of the base frame. Upon reaching the final shipping destination, thereafter, the base frame component and the combustion chamber frame component are removed from their respective shipping containers and the pair of tracks or the wheels (or possibly the set of stationary legs) are then secured to the base frame component. Next, the combustion chamber frame component can be assembled with the base frame component to complete assembly of the portable or stationary combustion system. Lastly, the portable combustion system can be operated to move the portable or stationary combustion system to a desired location for combustion of waste material while the stationary combustion system is typically physical set up at the desired location where combustion of the waste material is to occur.

Yet another object is to eliminate the need to dig a pit or trench or to build any ramp which is required to be used in conjunction with the portable or stationary combustion system thereby to improve and simplify transportation and movement of the portable or stationary combustion system from one location to another.

Still another object is to provide the portable or stationary combustion system with a camera, or some other viewing device, which facilitates viewing of the combustion by an operator, as such combustion occurs within the combustion chamber so that the operator can monitor such combustion and determine if a combustion problem exists or when to feed additional waste material into the combustion chamber.

Yet another object is to utilize at least a first blower coupled to an air manifold for supplying a first source of combustion air across the top of the combustion chamber and forming an air curtain during operation, and couple a second blower to an air supply duct for supplying a second source of combustion air through a plurality of openings, holes or apertures formed in the perforated plate and into the combustion chamber to assist with combustion of the waste material contained within the combustion chamber provide the portable or stationary combustion system.

The present invention also relates to a combustion system comprising: a combustion chamber frame; a base frame; a second end of the combustion chamber frame being pivotably attached to a second end of the base frame; the combustion chamber frame defining a combustion chamber; a perforated plate forming a bottom surface of the combustion chamber, and the perforated plate having a plurality of openings formed therein; the combustion chamber being open along at a top thereof to facilitate feeding of waste material into the combustion chamber; at least one blower for supplying combustion air to the combustion chamber to assist with combustion of the waste material; and the at least one blower being coupled to an air manifold for supplying a first source of combustion air across the top of the combustion chamber and forming an air curtain across the open top during operation of the combustion system, and the at least one blower being coupled to an air supply duct for supplying a second source of combustion air through a bottom surface of the perforated plate and into the combustion chamber to assist with combustion of the waste material contained within the combustion chamber.

The present invention also relates to a method of combusting waste material in a combustion system, the method comprising: providing a combustion chamber frame; providing a base frame; pivotably attaching a second end of the combustion chamber frame to a second end of the base frame; defining a combustion chamber on the combustion chamber frame; using a perforated plate to form a bottom surface of the combustion chamber, and forming plurality of openings in the perforated plate; leaving a top of the combustion chamber open to facilitate feeding of the waste material into the combustion chamber; supplying combustion air to the combustion chamber, via at least one blower, to assist with combustion of the waste material, and dividing the combustion air into first and second sources of combustion air; supplying the first source of combustion air, via an air manifold, across the top of the combustion chamber to form an air curtain; and supplying the second source of combustion air through the plurality of openings, formed in the perforated plate, and into the combustion chamber, via an air supply duct, to assist with combustion of the waste material contained within the combustion chamber.

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of the invention. The invention will now be described, by way of example, with reference to the accompanying drawings in which.

It should be understood that the drawings are not necessarily to scale and that the disclosed embodiments are sometimes illustrated diagrammatically or in partial view. In certain instances, details which are not necessary for an understanding of this disclosure, or which render other details difficult to perceive, may have been omitted. It should be understood, of course, that this disclosure is not limited to the particular embodiments illustrated herein.

DETAILED DESCRIPTION OF THE PREFERRED EMBODIMENTS

The present invention will be understood by reference to the following detailed description, which should be read in conjunction with the appended drawings. It is to be appreciated that the following detailed description of various embodiments is by way of example only and is not meant to limit, in any way, the scope of the present invention.

Figure 1:
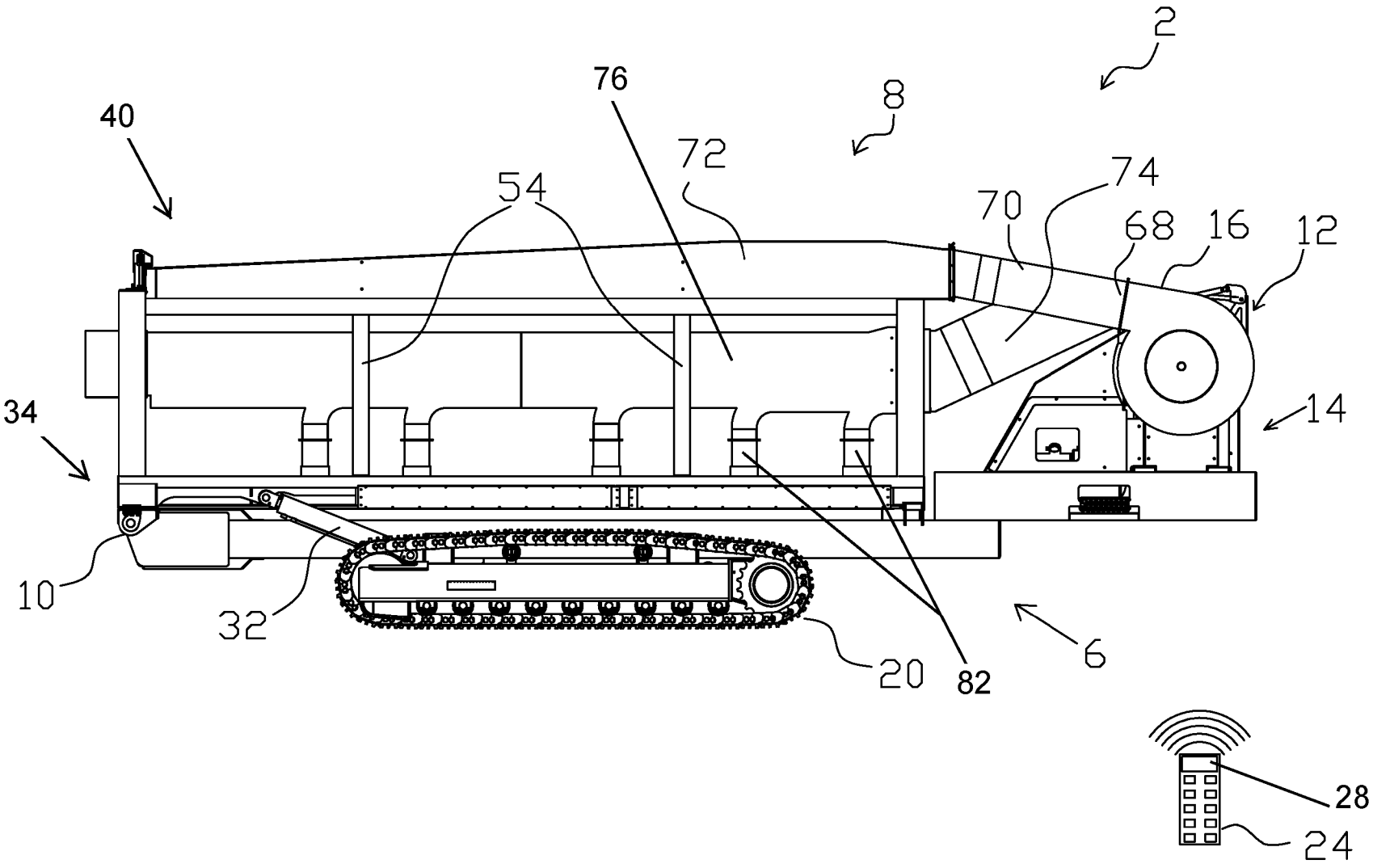
FIG. 1 is a diagrammatic right side elevational view of the portable combustion system.
Figure 2:
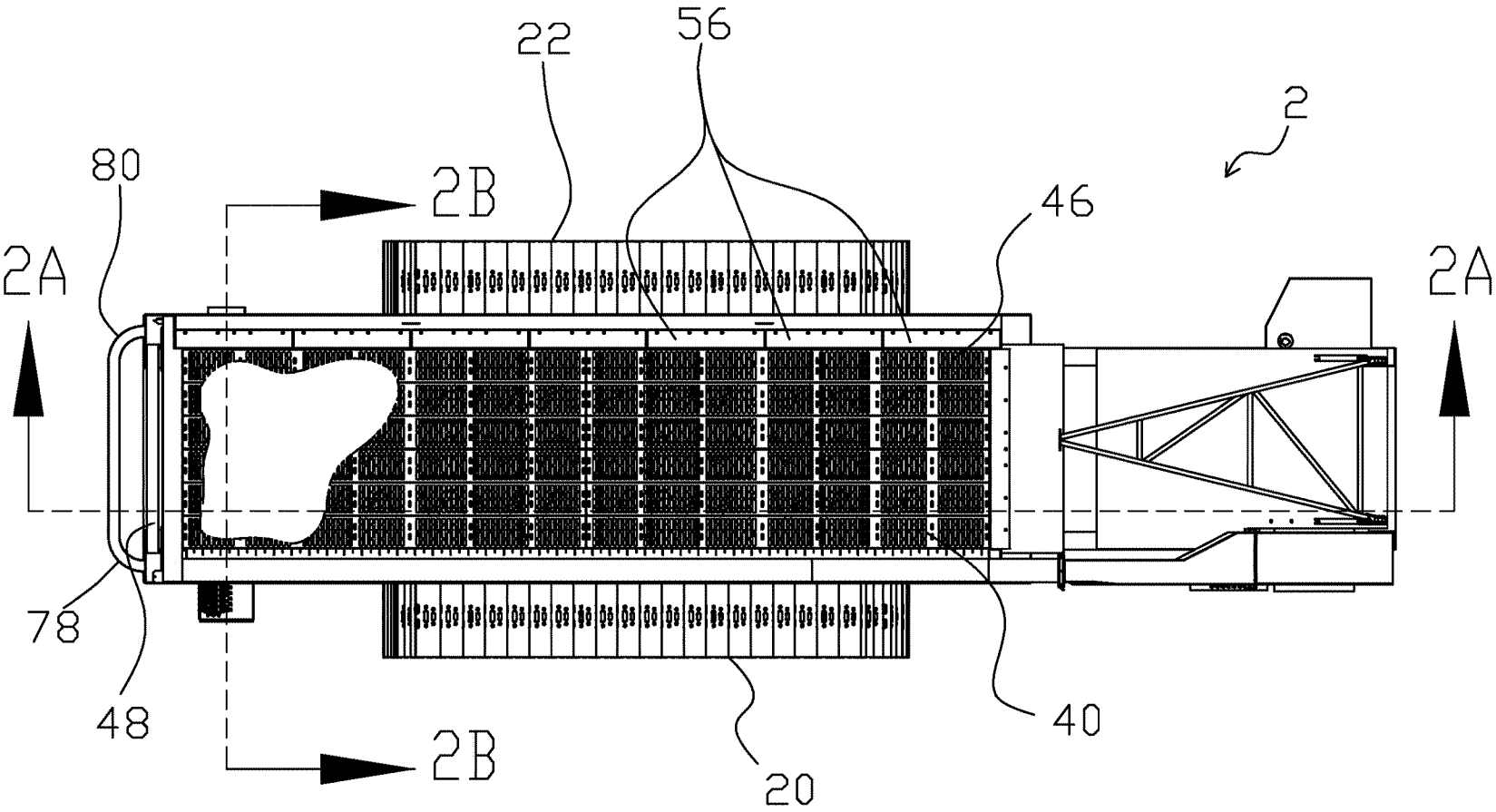
FIG. 2 is a diagrammatic top plan view of the portable combustion system of FIG. 1.
Figure 2A:
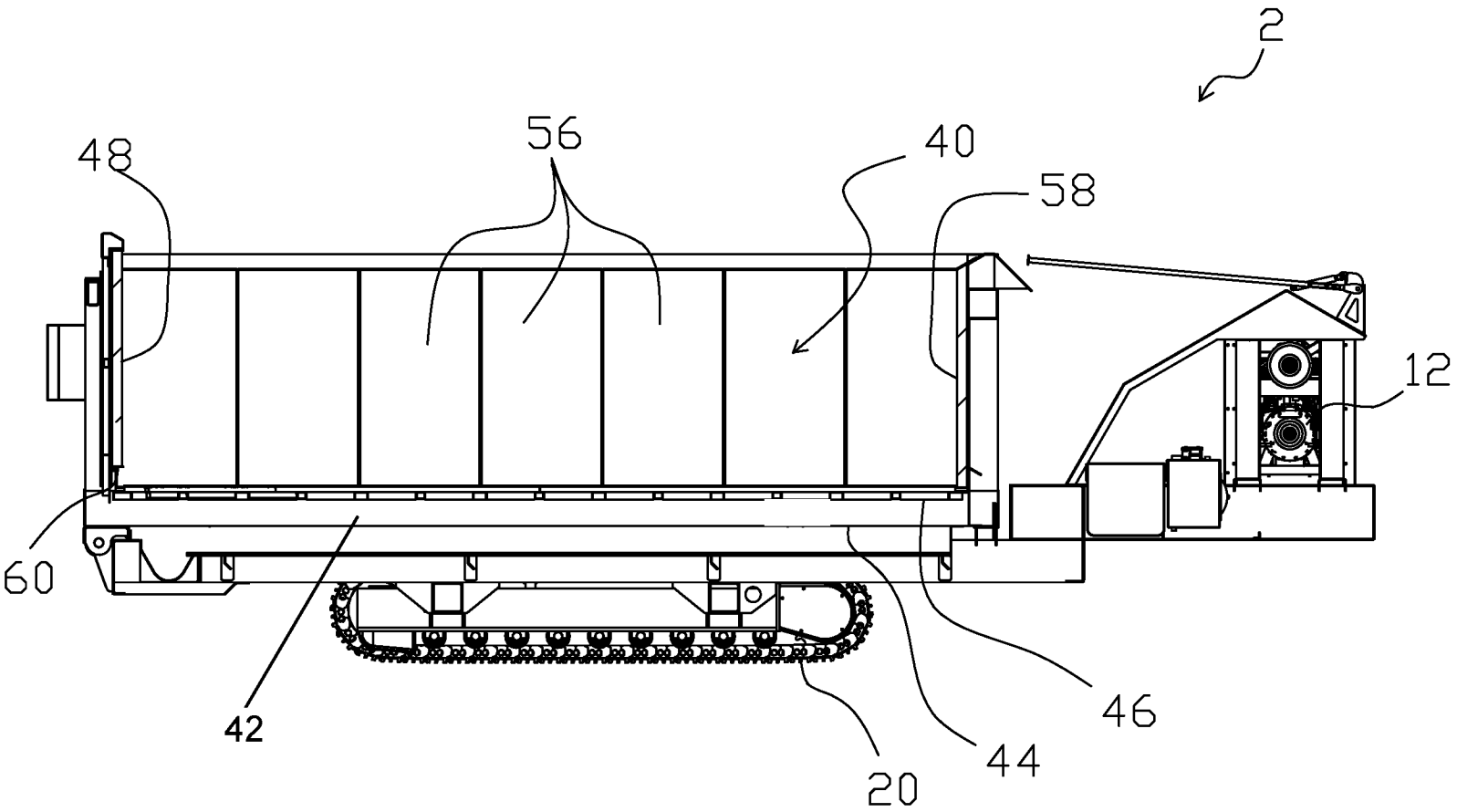
FIG. 2A is a diagrammatic cross-sectional view taken along section line 2A-2A of FIG. 2.
Figure 2B:
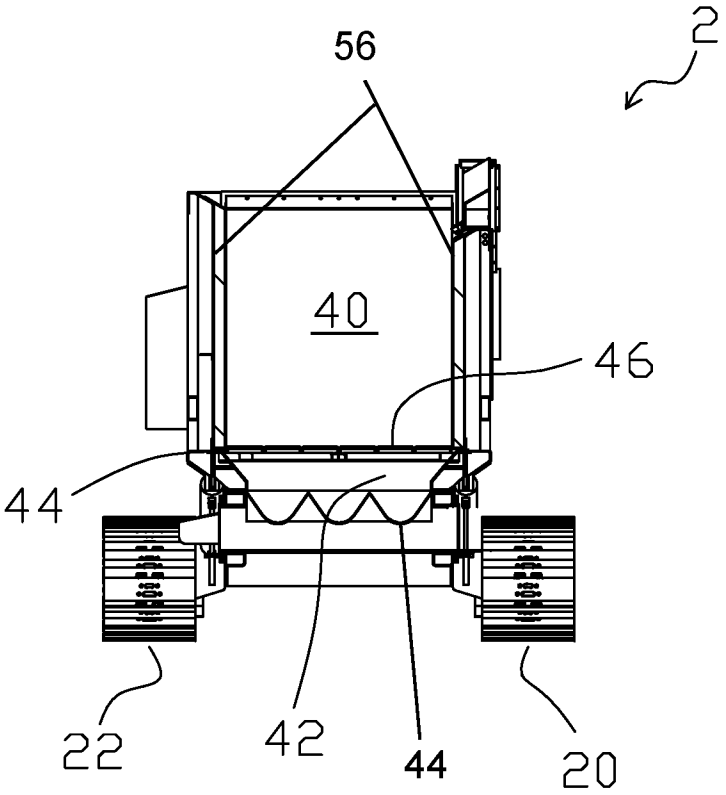
FIG. 2B is a diagrammatic cross-sectional view taken along section line 2B-2B of FIG. 2.
Figure 3:
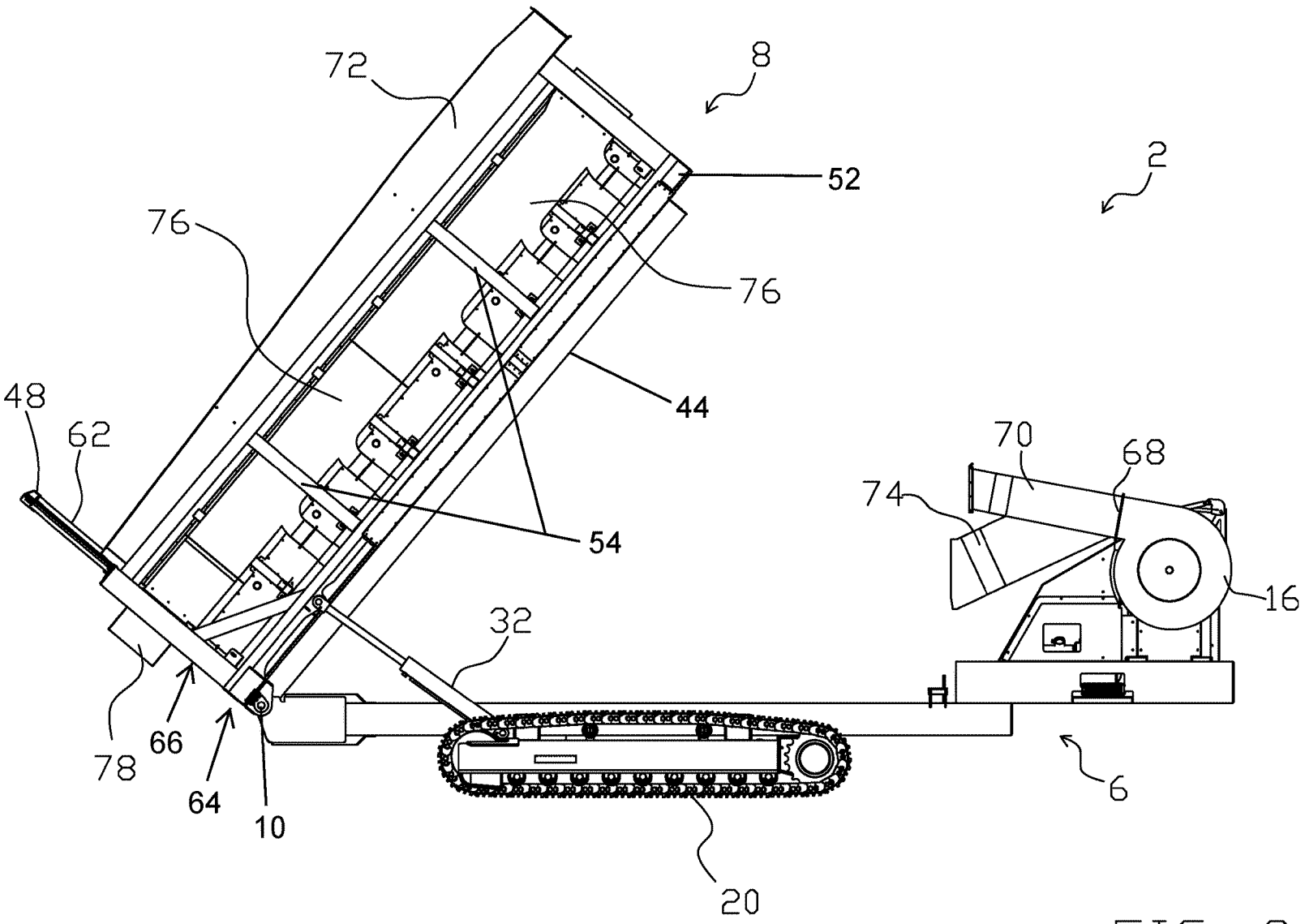
FIG. 3 is a diagrammatic side elevational view of the portable combustion system of FIG. 1 with the combustion chamber frame pivoted into a discharge positioned for discharging the accumulated ash, char, biochar, clinkers, soot, unburnt debris, etc., from the plenum and/or the combustion chamber, depending upon a position of the slidable gate.
Figure 4:
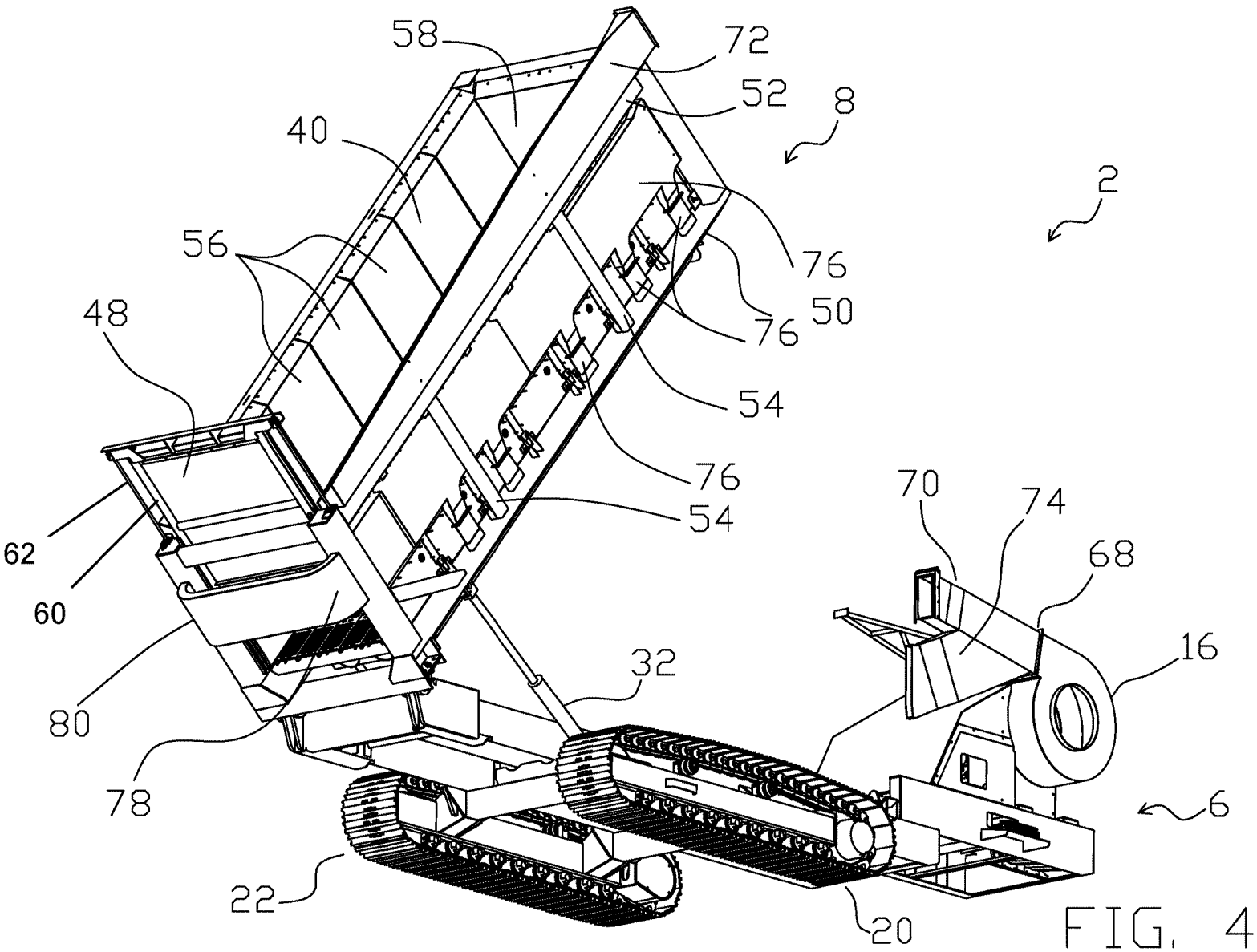
FIG. 4 is a diagrammatic bottom, rear, right side perspective view of the portable combustion system of FIG. 3.

Turning first to FIGS. 1, 2, 2A, 2B, 3 and 4, a brief description concerning the various components of the present invention will now be briefly discussed. As can be seen in this first embodiment, the present invention relates to a self propelled portable combustion system 2 which can be easily and readily transported to a desired site and set up in order to facilitate substantially complete combustion of the desired waste material 4, e.g., vegetative waste, biomass, processed wood, chips, bark, ground wood, and/or other municipal solid waste (MSW), which is located at that site. The portable or stationary combustion system 2 comprises both a base frame 6 and a combustion chamber frame 8. A second end of the combustion chamber frame 8 is pivotably connected to the base frame 6 by a horizontal pivot or hinge 10 (see FIGS. 2A and 3, for example), and the horizontal pivot or hinge 10 generally extends across the entire width of second end of the portable or stationary combustion system 2 so as to permit the combustion chamber frame 8 to pivot relative to the base frame 6, as generally shown in FIGS. 3 and 4. A further description concerning the purpose of such pivoting movement of the combustion chamber frame 8, relative to the base frame 6, will become apparent from the following description.

At least one engine 12 (see FIG. 2A), e.g., a 50-150 horsepower diesel powered engine for the portable combustion system 2 or a plurality of electric motors for the stationary combustion system 2, is supported on the base frame 6, in a conventional manner, adjacent a leading first end 14 of the portable or stationary combustion system 2. An output shaft of the engine 12 drives a conventional (single) blower 16 which is also supported, in a conventional manner, by the base frame 6 adjacent the leading first end 14 of the portable or stationary combustion system 2. The blower 16, when driven by the engine 12, draws in surrounding air and generates a flow of combustion air which assists with combustion of the waste material 4, and a further discussion concerning such combustion air will become readily apparent from the following description. In addition, the engine 12 also drives a hydraulic pump (not shown in detail) which pumps hydraulic fluid and thus generates a source of hydraulic pressure 18 for controlling operation of the portable or stationary combustion system 2, as discussed below in further detail.

For the portable combustion system 2, the base frame 6 is supported on a drive assembly, e.g., at least first and second sets of drivable wheels or first and second spaced apart and independently drivable tracks 20, 22. In the case of independently drivable tracks 20, 22, each one of the first and second tracks 20, 22 is supported by a set of conventional sprockets, or some other conventional rotatable components, which facilitate rotation of the respective track 20 or 22 relative to the base frame 6. At least one of the sprockets, of each of the first and second tracks 20, 22, is coupled to the source of hydraulic pressure 18 to facilitate supplying hydraulic pressure thereto and rotationally driving that respective sprocket and the associated track 20 or 22 in a desired rotational direction. As a result of this arrangement, each of the first and second tracks 20, 22 can be independently driven in either a forward or a reverse driving direction as well as driven at a variety of different rotational speeds. In the case of the first and second sets of drivable wheels, at least one of the wheels, of each set, is coupled to the source of hydraulic pressure 18 to facilitate supplying hydraulic pressure thereto and rotationally driving that respective wheel in a desired rotational direction The portable combustion system 2 is equipped with a remote radio controller 24 (see FIG. 1) which communicates wirelessly with a control panel 26 affixed to the base frame 6 of the portable combustion system 2. The control panel 26 controls operation of the engine 12, the hydraulic pump and the supply of the hydraulic pressure to the first and the second endless tracks 20, 22 in order to control forward and reverse travel, turning and/or repositioning of the portable or stationary combustion system 2, as required or desired by the operator. As operation of tracked vehicles is conventional and well known in the art, a further detailed description concerning the same is not provided.

It is to be appreciated that the radio controller 24 is generally small enough to be held in the hand of the operator so that the communicated inputted commands, from the operator, are transmitted wirelessly by the radio controller 24 to the control panel 26 which, in turn, implements the inputted commands to control operation of the portable or stationary combustion system 2. The radio controller 24 is also equipped with a small display 28 to facilitate displaying images received from a viewing device 30 (see FIG. 7), as will be discussed below in further detail, during operation of the portable or stationary combustion system 2.

The stationary combustion system 2 may be equipped with a remote radio controller 24 which communicates wirelessly with a control panel 26 affixed to the base frame 6 of the stationary combustion system 2. The control panel 26 controls operation of the engine 12, the hydraulic pump, etc., in order to control remotely operation of the stationary combustion system 2, as required or desired by the operator.

As shown in FIGS. 1, 1A, 3 and 4, at least one, more preferably a pair of hydraulic frame piston/cylinders 32 are located toward the second end 34 of the portable or stationary combustion system 2 in order to facilitate lifting of the first end of the combustion chamber frame 8 away from the first end of the base frame 6 and thereby pivoting the combustion chamber frame 8, about the horizontal hinge 10 with respect to the base frame 6, into a dumping or discharge position (see FIGS. 3 and 4) for discharging relatively large accumulated ash, char, biochar, clinkers, soot, unburnt debris, etc., 36, from a combustion chamber 40 as well as discharging relatively small accumulated fine ash, char, biochar, soot, debris and/or small particles 38 from an internal plenum 42 located vertically below the combustion chamber 40, as discussed below in further detail.

As diagrammatically shown in those Figures, a first cylinder end of the frame hydraulic piston/cylinder 32 is connected to an intermediate section of the base frame 6 while an opposed second piston end of frame hydraulic piston/cylinder 32 is connected to the combustion chamber frame 8, adjacent the second end of the combustion chamber frame 8. Each one of the frame hydraulic piston(s)/cylinder (s) 32 is connected, by conventional hydraulic lines (not shown), to the source of hydraulic pressure 18. When hydraulic pressure is supply to a first side of the piston, the piston is biased away from a base portion of the cylinder thereby increasing the overall length of the frame hydraulic piston/cylinder 32 and, in turn, raising of the first end of the combustion chamber frame 8 away from the first end of the base frame 6 and pivoting of the combustion chamber frame 8, about the horizontal pivot 10, into the dumping or discharge position (see FIGS. 3 and 4). On the other hand, when hydraulic pressure is supply to an opposed second side of the piston, the piston is moved toward the base portion of the cylinder thereby decreasing the overall length of each of the frame hydraulic piston/cylinders 32 and lowering of the first end of the combustion chamber frame 8 toward the first end of the base frame 6 and pivoting of the combustion chamber frame 8, about the horizontal pivot 10, until the combustion chamber frame 8 again rests on the base frame 6.

A solid base plate 44 extends along and forms a bottom surface of the combustion chamber frame 8 (see FIG. 3). A perforate plate 46 is located above the base plate 44, of the combustion chamber frame 8, and extends parallel to the base plate 44 but is spaced therefrom (see FIG. 2). The base plate 44 is secured to the combustion chamber frame 8, e.g., by welding or conventional fasteners. The base plate 44 is typically fabricated from metal, such as steel or stainless steel, and has a thickness of between ⅛ and ½ inches or so. The perforate plate 46 is typically spaced and located between 3 inches and 12 inches vertically above the base plate 44 and the perforate plate 46, in turn, forms the bottom surface of the combustion chamber 40. The perforate plate 46 is secured to the combustion chamber frame 8, e.g., by welding or conventional fasteners, and is typically fabricated from metal, such as steel or stainless steel, and has a thickness of between ⅜ and 4 inches or so. The perforate plate 46 has a plurality of spaced apart openings, holes or apertures (not labeled) formed therein, e.g., 1/16 to 4 inches diameter holes (see FIG. 2), typically about ⅛ inch diameter holes, which facilitate fine ash, char, biochar, soot, debris and/or small particles 38 falling through the perforate plate 46 and collecting on a top surface of the base plate 44. The small plurality of openings, holes or apertures may be of any desired shape or size which facilitate fine ash, char, biochar, soot, debris and/or small particles 38 falling through which also facilitate a supply of combustion air up through plurality of equally spaced small plurality of openings, holes or apertures formed in the perforate plate 46, into the combustion chamber 40, as will be described below in further detail.

As will be described below in further detail, two longitudinal plenum sidewalls, which extend along longitudinal edges of the base plate 44 and longitudinal edges of the perforate plate 46, facilitate suppling combustion air to the space located between these the base and the perforate plates 44, 46. A leading first end plenum wall, which extends between the leading first edge of the base plate 44 and a leading first edge of the perforate plate 46, is a solid end fixed wall while an opposed trailing second end wall, which extends between a trailing second edge of the base plate 44 and a trailing second edge of the perforate plate 46, is closed by a movable second ceramic member 48 which is supported by a pair of slidable gate supports 60, the purpose of the movable second ceramic member 48 will become apparent from the following description.

The term "plenum" 42, as referred to within this patent application, is defined as the space located between and defined by the base plate 44, the perforate plate 46, the two vertically extending longitudinal plenum sidewalls, the vertically extending first leading plenum end wall, and the vertically movable second ceramic member 48.

The combustion chamber frame 8 supports a pair of upper and lower lateral horizontal supports 50, 52 as well as a plurality of spaced apart vertical supports 54 which are connected to and extend substantially normal between the upper and lower lateral horizontal supports 50, 52. Each one of the vertical supports 54 is spaced from an adjacent vertical support 54. The upper and lower lateral horizontal supports 50, 52 and the vertical supports 54 together form a framework of the combustion chamber frame 8 to which components of the portable or stationary combustion system 2 are fastened. A plurality of ceramic members 56 (see FIGS. 2A and 2B), or some other refractory material, are typically secured in a conventional manner to one or more of the horizontal and/or vertical supports 50, 52, 54 of the combustion chamber frame 8 in a close side-by-side abutting relationship, as shown in FIGS. 1 and 2A, along each of the opposed lateral sidewalls of the combustion chamber frame 8. Each one of the ceramic members 56 is typically securely but releasably fastened, e.g., by a plurality of conventional fasteners (not shown in detail), to the one or more horizontal and/or vertical supports 50, 52, 54 of the combustion chamber frame 8. Such releasable attachment facilitates replacement, repair and/or servicing of one or more of the ceramic members 56, in the event that one of the ceramic members 56 becomes cracked or is otherwise damaged during use.

As generally shown in FIG. 2A, typically seven ceramic members 56 are arranged, side by side and closely adjacent one another, along the second longitudinal sidewall of the combustion chamber 40 of the portable or stationary combustion system 2 and an additional seven ceramic members 56 are typically similarly arranged, side by side and adjacent one another, along the opposed first longitudinal sidewall of the combustion chamber 40. Each one of these ceramic members 56, for example, has a height of between 60 and 100 inches, a width of between 30 and 60 inches and a thickness of between 2 and 4 inches. In addition, a first end fixed ceramic member 58 is releasably secured to the first leading end of the combustion chamber 40, to facilitate replacement and/or servicing thereof, while the movable second (end) ceramic member 48 is movably secured to the trailing second end of the combustion chamber 40. Each one of the first and the second end ceramic members 58, 48 typically has a height of between 60 and 100 inches, a width of between 30 and 80 inches and a thickness of between 2 and 4 inches.

The combustion chamber 40 is defined by the perforate plate 46, the plurality of ceramic members 56 arranged along each one of the first and second longitudinal sideswalls, the first and second end ceramic members 58, 48 and an open top which provides access to the combustion chamber 40 to facilitate loading of the waste material 4 therein as well as the escape of combustion gases therefrom.

The first end ceramic member 58 is fixedly but releasably secured to the one or more horizontal and/or vertical supports 50, 52, 54 of the combustion chamber frame 8, adjacent the leading first end of the portable or stationary combustion system 2. The second (end) ceramic member 48, on the other hand, is fixedly secured to a pair of slidable gate supports 60 located adjacent the trailing second end 34 of the portable or stationary combustion system 2. The slidable gate supports 60, along with the second (end) ceramic member 48, are able to slide up and down, relative to the base plate 44 of the combustion chamber frame 8 along and within a respective gate guide (not shown in detail), and thus forms an openable/closeable gate. A respective gate piston/cylinder 62 is connected to each one of the slidable gate supports 60 to induce sliding movement of the slidable gate supports 60 and the second (end) ceramic member 48 along a pair of mating but stationary slidable guides. Each of the gate hydraulic piston(s)/cylinder(s) 62 is connected, by conventional hydraulic lines (not shown in detail), to the source of hydraulic pressure 18 and the control panel 26 controls the supply of hydraulic pressure to the hydraulic gate piston(s)/cylinder(s) 62 for selectively raising and lowering the second (end) ceramic member 48, as required by the operator.

When hydraulic pressure is supply to a first side of the piston, the piston is biased away from a base portion of the cylinder thereby increasing an overall length of the hydraulic gate piston/cylinder 62 and moving the slidable supports 60, as well as the secured second end ceramic member 48, away from the base plate 44 by a distance of a few inches or so to a few feet or so to open first at least a discharge outlet 64 of the plenum. When hydraulic pressure is supply to an opposed second side of the piston, the piston is biased toward the base portion of the cylinder thereby decreasing the overall length of the hydraulic gate piston/cylinder 62 and moving the slidable supports and the second ceramic member 48 back into abutting engagement with the base plate 44, i.e., the second (end) ceramic member 48 is moved into a combustion position thereby closing both the discharge outlet 64 of the plenum and a discharge outlet 66 of the combustion chamber to prevent discharge of ash, char, biochar, clinkers, soot, small particles and/or unburnt debris, etc., 36, 38, therefrom.

Figure 5C:
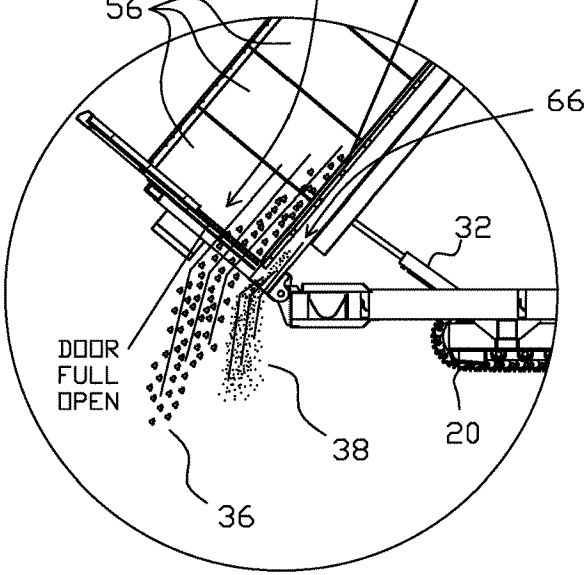
FIG. 5C is a partial diagrammatic cross-sectional side view of the sliding gate shown in its fully raised position thereby opening the discharge outlets of both the plenum and the combustion chamber to facilitate discharging relatively smaller accumulated fine ash, char, biochar, soot, small particles and/or debris from the plenum as well as discharging relatively larger accumulated ash, char, biochar, clinkers, soot, unburnt debris, etc., from the combustion chamber.
Figure 5B:
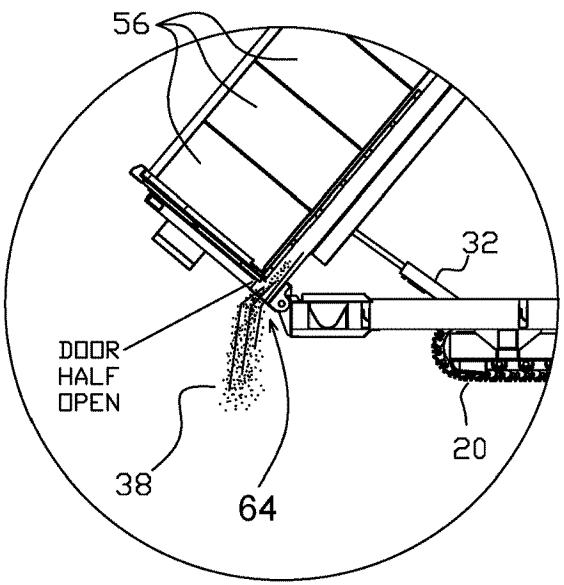
FIG. 5B is a partial diagrammatic cross-sectional side view of the sliding gate shown in its partially raised position, with the bottom edge coincident with a plane defined by the perforated plate, to facilitate discharging only fine ash, char, biochar, soot, small particles and/or debris which accumulate in the plenum located below the perforated plate.
Figure 5A:
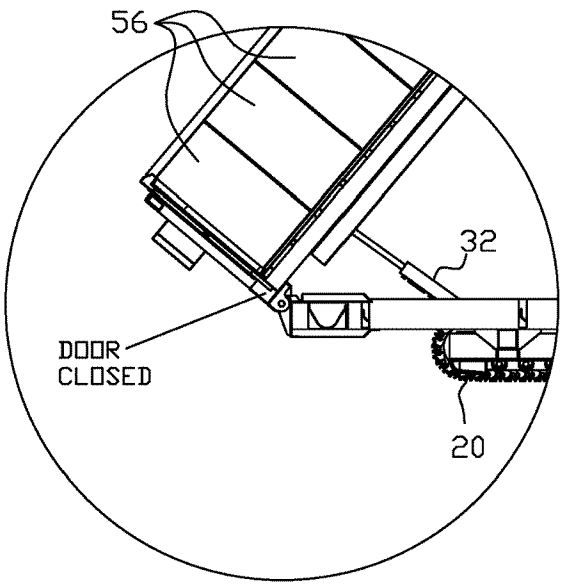
FIG. 5A is a diagrammatic partial cross sectional view of the sliding gate shown in its closed position in abutting engagement with the bottom surface of the combustion chamber frame preventing any discharge of accumulated ash, char, biochar, clinkers, soot, unburnt debris, etc., from either the plenum and/or the combustion chamber.

When dumping or discharging of the accumulated fine ash, char, biochar, soot, debris and/or small particles 38 from the plenum 42 as well as dumping discharging of the accumulated ash, char, biochar, clinkers, soot, unburnt debris, etc., 36, from the combustion chamber 40 is desired or required, the gate piston(s)/cylinder(s) 62 is/are actuated to move the second (end) ceramic member 48 out of engagement with the base plate 44 from its closed position (see FIG. 5A) and thereby commence opening the discharge outlet 64 of the plenum. If the second (end) ceramic member 48 is only partially raised such that a bottom edge of the second (end) ceramic member 48 is flush with and lies in a plane defined by the perforate plate 46 (see FIG. 5B), then only the relatively smaller fine ash, char, biochar, soot, debris and/or small particles 38, which have collected in the plenum 42, located between the base plate 44 and the perforate plate 46, will be discharged, via gravity, when the first end of the combustion chamber frame 8 is pivoted away from the first end of the base frame 6, about the horizontal hinge 10, into the dumping or discharge position (see FIGS. 3 and 4), while the burning waste material 4 will tend to slide toward the second (end) ceramic member 48, due to gravity, but be prevented by the second (end) ceramic member 48, i.e., the gate, from sliding out of the combustion chamber 40.

However, if the second (end) ceramic member 48 is raised such that a bottom edge of the second (end) ceramic member 48 is located sufficiently above the perforate plate 46 (see FIG. 5C), then both of the discharge outlets 64, 66 are opened. As a result, the relatively smaller fine ash, char, biochar, soot, debris and/or small particles 38, which have accumulated within the plenum 42, are discharged out through the discharge outlet 64 of the plenum while the relatively larger ash, char, biochar, clinkers, soot, unburnt debris, etc., 36, which have accumulated on the perforate plate 46 in the combustion chamber 40 are also discharged, by gravity, out through the discharge outlet 66 of the combustion chamber 40 once the first end of the combustion chamber frame 8 is sufficiently raised and pivoted away from the first end of the base frame 6 about the horizontal hinge 10.

As shown in FIGS. 1, 2, 3 and 4, a Y-coupling 68 is connected to an outlet end of the blower 16 for dividing the flow of the combustion air, from the blower 16, into a first source of combustion air and a separate and distinct second source of combustion air. A first outlet 70 of the Y-coupling 68 sealing engages with, but is releasably connected to an inlet end of a tapered air manifold 72 which is arranged and extends typically along an upper first longitudinal edge of the combustion chamber 40. The tapered air manifold 72 is secured to the upper horizontal support 52 which extends along the first longitudinal side of the combustion chamber frame 8. An annular rubber seal (not shown in detail) is provided on at least one of the first outlet 70 of the Y-coupling 68 or an inlet end of the air manifold 72 in order to form a tight seal therebetween, when the combustion chamber frame 8 is in the lowered position shown in FIGS. 1 and 2. Alternative, as shown and discussed below in further detail with reference to FIG. 1A, the single blower 16 and the Y-coupling 68, described above, may both be replaced by first and second blowers 16' and 16" which respectively supply combustion air to the tapered air manifold 72 and the air supply duct 76.

As generally shown in FIGS. 1 and 3, the internal transverse cross sectional area of the air manifold 72 generally or gradually tapers toward a smaller internal transverse cross sectional area from the leading first end toward the trailing second end of the combustion chamber frame 8 where the air manifold 72 terminates, e.g., the air manifold 72 may include a first tapered section, a second tapered section and a third tapered section. The taper of the air manifold 72 is designed to assist with uniformly discharging the supplied first source of combustion air laterally across the entire open top of the combustion chamber 40 and toward the opposite longitudinal sidewall of the combustion chamber 40, but in a slight downwardly inclined air flow direction.

The air manifold 72 has a plurality of outlets, openings slots or one or more elongate slits (not shown in detail) along the length thereof which are designed to discharge the first source of combustion air laterally across the entire open top of the combustion chamber 40. The first source of combustion air, exhausting from the air manifold 72, is discharged so as to form an "air curtain" which extends completely across the open top of the combustion chamber 40, i.e., from the first longitudinal sidewall to the opposed second longitudinal sidewall as well as from the leading first end wall to the trailing second end wall of the combustion chamber 40. This air curtains assists with preventing the escape of any substantial amount of smoke, particulate matter, other air borne debris, etc., from the combustion chamber 40, during combustion, thereby resulting in relatively clean burning of the waste material 4.

The first source of combustion air, once that air reaches the opposite side wall of the combustion chamber 40, is typically deflected off the opposed lateral sidewall downwardly, due to the slight downwardly inclined air flow direction of the first source of combustion air, and toward the bottom portion of the combustion chamber 40 to provide additional combustion air for the waste material 4 burning within the combustion chamber 40 and thereby improve overall combustion of the waste material 4.

A second outlet 74 of the Y-coupling 68 also sealing engages with, but is releasably connected to an inlet of an air supply duct 76 which is supported by the combustion chamber frame 8. An annular rubber seal (not shown in detail) is provided on at least one of the second outlet 74 of the Y-coupling 68 or an inlet end to the air supply duct 76 in order to form a tight seal therebetween when the combustion chamber frame 8 is in the operative position, shown in FIG. 1. The air supply duct 76 extends along an intermediate section of the first longitudinal sidewall of the combustion chamber 40 and internally gradually tapers in transverse cross sectional area from the leading first end toward the trailing second end of the combustion chamber frame 8. The air supply duct 76 is positioned so as to be in intimate contact with a rear surface of the ceramic members 56, installed along the first longitudinal sidewall of the combustion chamber 40, to assist with removing some of the heat from the ceramic members 56 and commence preheating of the second source of combustion air, as that air flows along the air supply duct 76. A first approximately 90 degree elbow 78 is located at the second end of the portable or stationary combustion system 2 (see FIG. 2).

Downstream of the first approximately 90 degree elbow 78, the air supply duct 76 extends along, but is spaced from, a rear surface of the second (end) ceramic member 48 so as not to inhibit or interfere with sliding movement of the second (end) ceramic member 48, relative to the second air supply duct 76, to open and close the discharge outlets 64, 66 of the plenum and the combustion chamber 40. A second approximately 90 degree elbow 80 is located at the second end of the combustion chamber 40 adjacent the second longitudinal side of the combustion chamber 40.

Downstream of the second approximately 90 degree elbow 80, the air supply duct 76 extends along the second longitudinal sidewall of the combustion chamber 40 gradually tapering in transverse cross sectional area toward the first end of the portable or stationary combustion system 2 where the air supply duct 76 eventually terminates. This portion of the air supply duct 76 is located so as to be in intimate contact with a rear surface of the ceramic members 56, installed along the second longitudinal sidewall of the combustion chamber 40, to assist with removing heat therefrom and further preheating of the second source of combustion air which flows along the air supply duct 76.

As shown in FIG. 1, a plurality of separate but spaced apart air feed ducts 82 are provided along the length of the air supply duct 76. Each one of the plurality of air feed ducts 82 extends vertically downward from the air supply duct 76 and communicates with an opening (not shown) formed in one of the longitudinal side walls of the plenum 42 in order to supply the second source of combustion air into the plenum 42. As noted above, the perforate plate 46 is provided with a plurality of openings, holes or apertures therein which permit the combustion air, which flows into the plenum 42, to be distributed throughout the plenum 42 and eventually flow up through the plurality of openings, holes or apertures in the perforate plate 46 and into the combustion chamber 40 to assist with combustion of the waste material 4 burning therein. Since the second source of combustion air is preheated, such preheating of this combustion air assists with substantially complete combustion of the waste material 4 and thereby increases the amount of the waste material 4 which can be consumed/burned per hour within the combustion chamber 40.

Figure 6A:
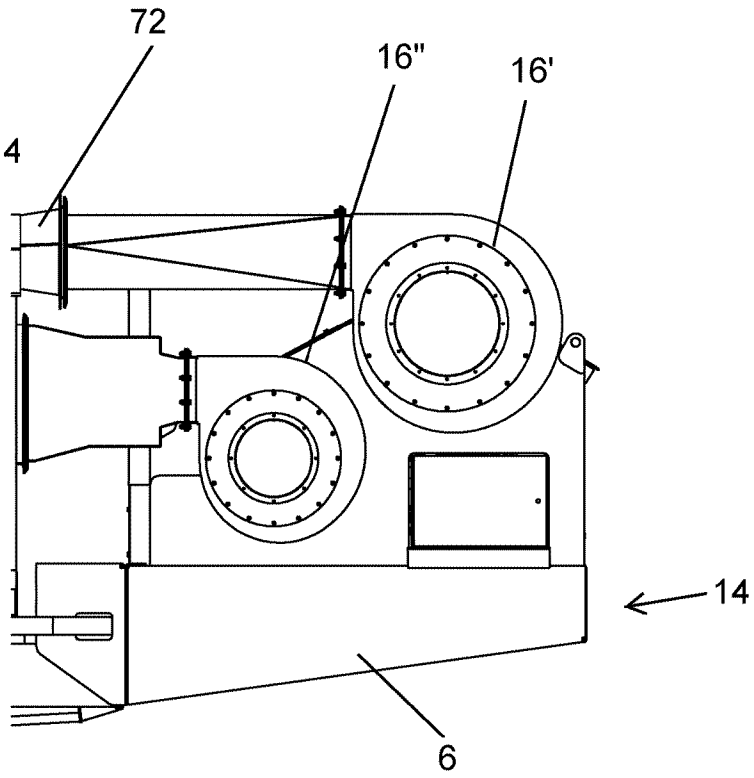
FIG. 6A is a diagrammatic side, similar to FIG. 6, showing an embodiment utilizing first and second blowers, instead of the single blower of FIG. 6, in which the first blower supplies combustion air to the air manifold while the second blower supplies combustion air to the air supply duct.
Figure 6:
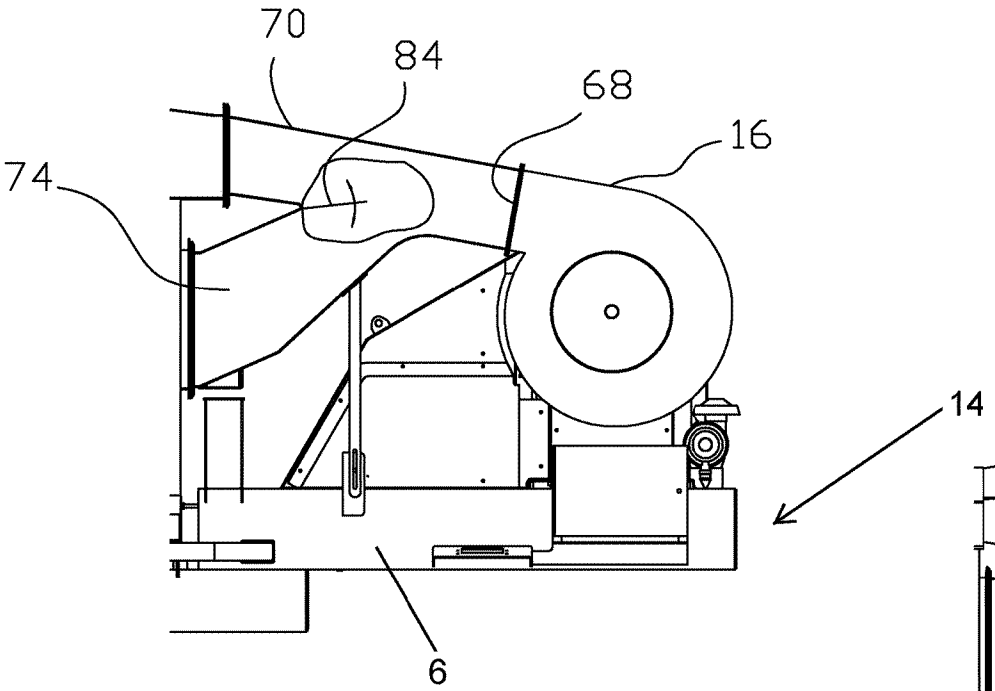
FIG. 6 is a diagrammatic partial cross sectional view of an adjustable damper located within the Y-coupling connected to the single blower which facilitates control of the distribution of the combustion air to either the air manifold or the air supply duct.

As shown in FIG. 6, an adjustable damper 84 is accommodated within the Y-coupling 68, typically in the intermediate region thereof immediately before the first and second outlets 70, 74. The adjustable damper 84 facilitates controlling distribution of the combustion air which is supplied by the blower 16 to either the air manifold 72 or the air supply duct 76. In a neutral position of the adjustable damper 84, a substantially equal amount of combustion air, from the blower 16, is distributed to each of the air manifold 72 and the air supply duct 76. However, it is to be appreciated that the adjustable damper 84, depending upon its orientation, can supply more combustion air to either the air manifold 72 or the air supply duct 76, depending upon the combustion requirements of the combustion chamber 40.

It is to be appreciated that only the perforate plate 46, the base plate 44, the horizontal and/or vertical supports 50, 52, 54, the ceramic members 56, the air supply duct 76 and the air manifold 72 are supported by the combustion chamber frame 8 and thus move therewith while all of the remaining components are generally supported by the base frame 6 and thus remain stationary, i.e., do not pivot with the combustion chamber frame 8. Such arrangement minimizes the amount of weight which must be lifted as the combustion chamber 40 of the combustion chamber frame 8 is raised and pivoted in order to remove and discharge ash, char, biochar, clinkers, soot, unburnt debris, etc., 36, 38, from the plenum 42 and the combustion chamber 40. It is to be appreciated that the plenum 42 must be sufficiently deep in order to permit the second source of combustion air to flow into the plenum 42 and be substantially uniformly distributed to each one of the plurality of openings, holes or apertures, formed in the perforate plate 46, and flow into the combustion chamber 40 while also allow a sufficient amount of the relatively smaller fine ash and other small particles 38 to pass therethrough and collect within the plenum 42.

Figure 1A:
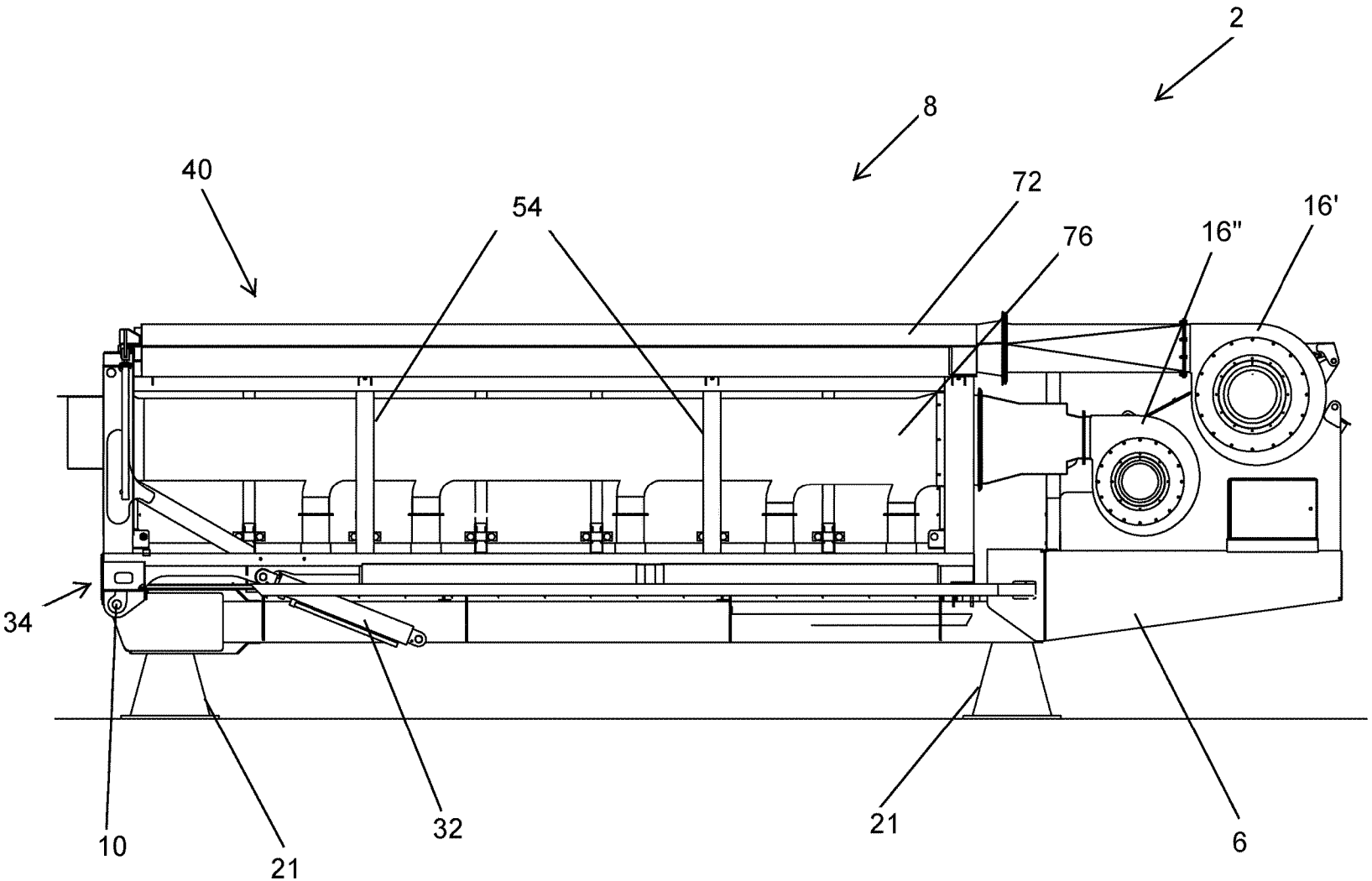
FIG. 1A is a diagrammatic right side elevational view of a stationary combustion system, very similar to FIG. 1, which is equipped with a plurality of stationary support legs as well as first and second blowers, instead of a single blower.

It is to be appreciated that FIGS. 1-4 show an embodiment of the portable combustion system 2 while FIG. 1A shows an embodiment of the stationary combustion system. 2 The major difference between the portable combustion system 2 and the stationary combustion system 2 is that the drive assembly, e.g., at least first and second sets of drivable wheels or the first and the second spaced apart and independently drivable tracks 20, 22, is replaced with at least two, or more preferably four or more, support legs 21 which are permanently secured to a bottom surface of the base frame 6 for supporting the stationary combustion system 2 on a desired surface or on the ground. Since the stationary combustion system 2, according to this embodiment, will typically operate at the same location for a prolonged period of time, one or more electric may be utilized for this stationary combustion system 2. In addition, as shown in this embodiment 2, the single blower of FIG. 1, for example, is replaced with first and second blowers 16', 16", which are describe in further detail below.

As shown in FIG. 6A, an output shaft of a first engine (not shown in detail) drives the first blower 16' which is also supported, in a conventional manner, by the base frame 6 adjacent the leading first end 14 of the portable or stationary combustion system 2. During operation, the first blower 16' draws in surrounding air and generates a first source of combustion air. An outlet of the first blower 16' sealing engages with, but is releasably connected to, an inlet end of the tapered air manifold 72 which is arranged and extends along an upper first longitudinal edge of the combustion chamber 40. The first blower 16' supplies the first source of combustion air to the tapered air manifold 72. An annular rubber seal (not shown in detail) is provided on at least one of the outlet of the first blower 16' or an inlet end of the air manifold 72 in order to form a fluid tight seal therebetween, when the combustion chamber frame 8 is in the lowered position.

An output shaft of a second engine (not shown in detail) drives the second blower 16" which is also supported, in a conventional manner, by the base frame 6 adjacent the leading first end 14 of the portable or stationary combustion system 2. During operation, the second blower 16" draws in surrounding air and generates a second source of combustion air. An outlet of the second blower 16" sealing engages with, but is releasably connected to an inlet end of the air supply duct 76 which is arranged and extends along an outer sidewall of the combustion chamber 40. The second blower 16" supplies the second source of combustion air to the air supply duct 76. An annular rubber seal (not shown in detail) is provided on at least one of the outlet of the second blower 16" or an inlet end of the air supply duct 76 in order to form a fluid tight seal therebetween, when the combustion chamber frame 8 is in the lowered position.

The portable or stationary combustion system 2 may be equipped with a fuel source 86, e.g., such as one or more refillable propane tanks. One or more nozzles 88 are installed within the combustion chamber 40 and each one of the nozzles is connected to the fuel source 86, via a conventional fuel line (not shown in detail), in order to supply fuel thereto. A fuel flow valve (not shown in detail) is located along the fuel line for controlling the flow of fuel from the fuel source 86 to the one or more nozzles 88. At least one of the plurality of nozzles 88, e.g., typically each one of the plurality of nozzles 88, has a conventional igniter (not shown in detail) associated therewith to assist with generating a spark and initiating a flame, when fuel is supplied from the fuel source 86 to the nozzle 88, and thereby ignite the waste material 4 contained within the combustion chamber 40. Since initiating combustion of the waste material 4 within the combustion chamber 40, via the gaseous fuel source and the nozzles, is conventional and well known in the art, a further description concerning the same is not provided.

Figure 7:
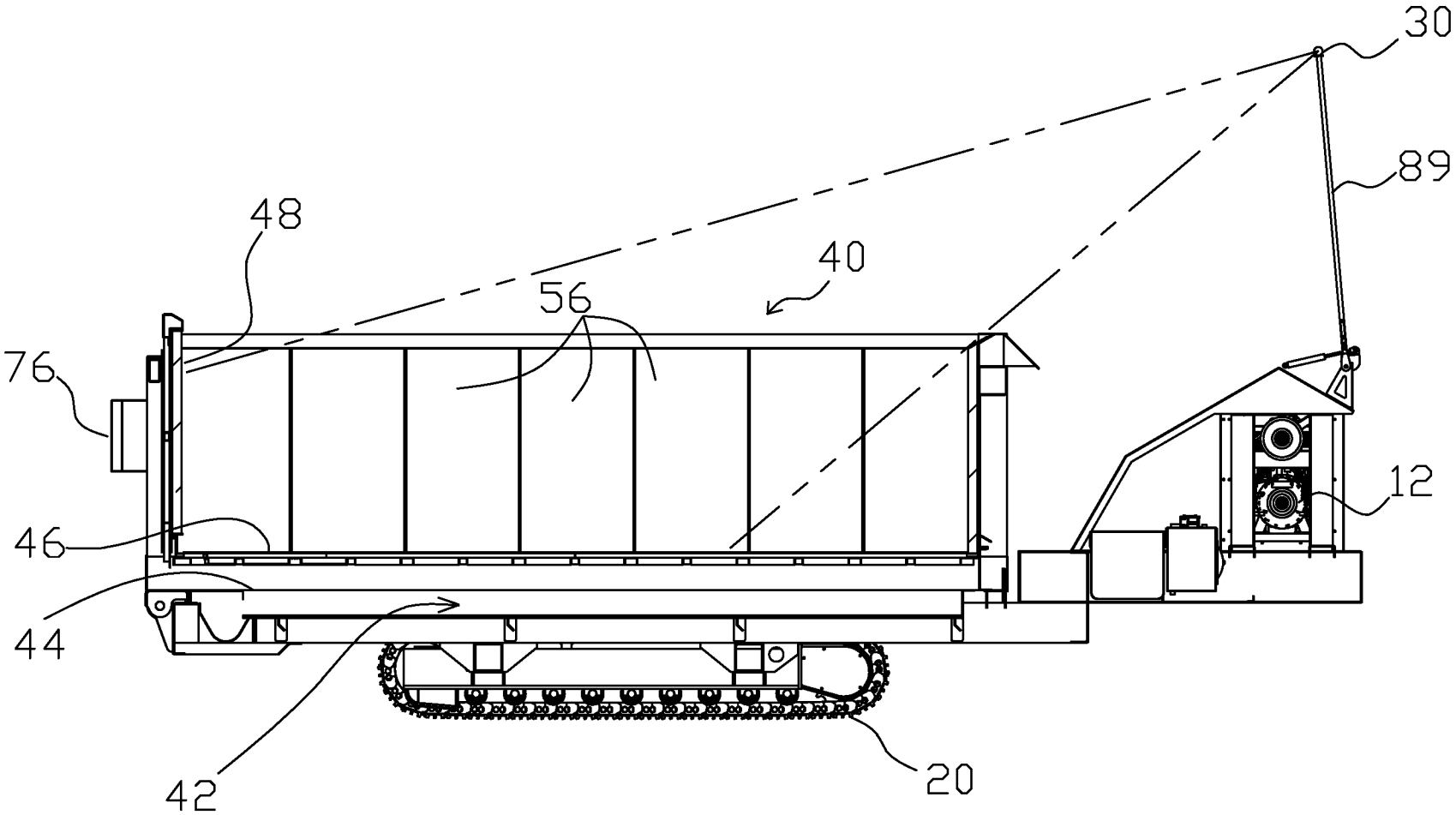
FIG. 7 is a diagrammatic side elevational view of the portable combustion system of FIG. 1 with a viewing device shown in its operative position for viewing combustion of the waste material occurring within the combustion chamber.

As shown in FIG. 7, the portable or stationary combustion system 2 is typically equipped with a viewing device 30, such as a camera, which permits viewing of the combustion chamber 40 by an operator. According to one embodiment, the viewing device 30 is attached to a free end of a movable/pivotable stand and the stand is movable from a storage position (see FIGS. 2 and 2A) to a deployed position (see FIG. 7), and vice versa. As shown in FIG. 7, when deployed, the viewing device 30 is able to view and monitor combustion of the waste material 4 within the combustion chamber 40. The viewing device 30 facilitates determining, by an operator, when additional waste material 4 should be added into the combustion chamber 40. As noted above, the radio controller 24 has a small display 28 which wirelessly communicates with the viewing device 30 to permit viewing of combustion, by the operator, as it is occurring within the combustion chamber 40.

Operation of the Portable or Stationary Combustion System

In the event that the portable or stationary combustion system 2 was shipped in a pair of conventional 40 foot shipping containers, typically the support or drive assembly, e.g., the support legs 21 or the wheels or the first and second endless tracks 20, 22, is removed from the base frame 6 in order to facilitate shipment in a pair of shipping containers. If the support or drive assembly was removed for shipment, then, following removal of the portable or stationary combustion system 2 from the pair of shipping containers, the base frame 6 is installed on either the support or the drive assembly. Thereafter, the combustion chamber frame 8 can then be secured to the base frame 6. In all other instances, the portable or stationary combustion system 2 will be transported to a desired destination in a fully assembled condition. Once the portable combustion system 2 arrives at the desired destination (and assembled if necessary), the operator can operate the radio controller 24, which communicates with the control panel 26, to maneuver the portable or stationary combustion system 2 into a desired location and commence combustion of the desired waste material 4. On the other hand, when the stationary combustion system 2 arrives assembled at the desired destination, the stationary combustion system 2 is typically unloaded or unpacked at the desired location so as to avoid utilizing equipment to reposition the stationary combustion system 2 to its desired operational location.

Next, an operator can then load waste material 4 into the combustion chamber 40 of the portable or stationary combustion system 2. Once a sufficient amount of waste material 4 is loaded into the combustion chamber 40, then the optional fuel supply valve is opened (either by the control panel 26 or manually by the operator) so that fuel is supplied from the fuel source 86 to the one or more of the nozzles 88 and, at the same time, the one or more igniter(s) located adjacent an outlet of the nozzles 88 are activated, by the control panel 26, to generate a spark and induce a flame within the combustion chamber 40. The flow of fuel to the nozzle(s) 88 continues until the waste material 4 is deemed by the operator to be sufficiently burning so as to maintain continuous combustion of the waste material 4 contained within the combustion chamber 40. Thereafter, the operator either manually closes, or the control panel 26 automatically closes, the fuel supply valve which thus interrupts the supply of fuel to the nozzle(s) 88. In the event that the portable or stationary combustion system 2 is not equipped with the optional fuel supply valve/fuel source/nozzles, then the waste material 4 is ignited by the operator in a conventional fashion.

Following continuous combustion of the waste material 4, conventional loading equipment can then be utilized to add additional waste material 4, as necessary, to the combustion chamber 40 via the opening formed in the top of the combustion chamber 40. This process of periodically feeding additional waste material 4 into the combustion chamber 40 continues until a sufficient amount of ash, char, biochar, clinkers, soot, unburnt debris, etc., 36, accumulates on the perforate plate 46 and/or a sufficient amount of fine ash or other small particles 38 accumulates within the plenum 42.

As note above, the relatively small fine ash, char, biochar, soot and/or small particles of unburnt debris 38 will typically fall through the plurality of openings, holes or apertures, formed in the perforate plate 46, and collect on the base plate 44, while the relatively larger ash, char, biochar, clinkers and other larger particles of unburnt debris will collect on the top surface of the perforate plate 46. In the event that an excessive amount of the fine ash, char, biochar, soot and/or small particles of unburnt debris 38 collect within the plenum 42 so as to obstruct the flow of the second source of combustion air into the combustion chamber 40, then the burning efficiency of the combustion chamber 40 will decrease significantly. Such a reduction in the burning efficiency of the combustion chamber 40 is an indicator to the operator that removal of the relatively small fine ash, char, biochar, soot and/or small particles of unburnt debris 38 from the plenum 42 and/or the relatively large ash, char, biochar, clinkers, soot, unburnt debris, etc., 36, from the combustion chamber 40, is generally required.

After a sufficient amount of ash, char, biochar, clinkers, soot, unburnt debris, etc., 36, e.g., between 3 inches and about 24 inches, accumulates on the perforate plate 46 of the combustion chamber 40, the operator will discontinue adding any additional waste material 4 to the combustion chamber 40 and permit the waste material 4 to continue burning until combustion of the waste material 4 is substantially discontinued. Thereafter, the operator can manipulate the radio controller 24 in order to maneuver the portable combustion system 2 to a desired dumping location and discharge the ash, char, biochar, clinkers, soot, unburnt debris, etc., 36, 38, which accumulate within the plenum 42 and/or the combustion chamber 40.

Once the portable combustion system 2 is located at the desired dumping or disposal location, the operator then manipulates the radio controller 24 to raise the gate and open the discharge outlets 64, 66 for both the plenum and the combustion chamber. Next, the operator then manipulates the radio controller 24 to raise and pivot the first end of the combustion chamber frame 8 relative to the first end of the base frame 6 into the discharge position shown in FIGS. 3 and 4.

As the combustion chamber frame 8 is raised and pivoted with respect to the base frame 6 to the discharge position shown in FIGS. 3 and 4, the ash, char, biochar, soot and/or small particles of unburnt debris 38, which accumulated within the plenum 42, as well as the ash, char, biochar, clinkers, soot, unburnt debris, etc., 36, which accumulated on the perforated base plate 46 of the combustion chamber 40, commence sliding toward the respective discharge outlets 64, 66 thereby substantially emptying both the plenum 42 and the combustion chamber 40. If desired or necessary, depending upon the amount of accumulated ash, char, biochar, clinkers, soot, unburnt debris, etc., 36, discharged from the plenum 42 and/or the combustion chamber 40, the operator may also manipulate the radio controller 24 to move the portable combustion system 2 a small distance away from the deposited pile of ash, char, biochar, clinkers, soot, unburnt debris, etc., 36, 38, in order to assist with complete emptying of the plenum 42 and/or the combustion chamber 40.

Then, the operator manipulates the radio controller 24 to lower and pivot the combustion chamber frame 8 relative to the base frame 6 back in the position shown in FIG. 1. Once the combustion chamber frame 8 is again lowered into abutting engagement with the base frame 6, the operator can then lower the gate thereby closing the discharge outlets 64, 66 for both the plenum 42 and the combustion chamber 40. Next, the operator can manipulate the radio controller 24 to position the portable combustion system 2 back either to the same working location or to a new desired location and then repeat the above process of burning additional waste material 4 until the discharge/dumping of the accumulated ash, char, biochar, clinkers, soot, unburnt debris, etc., 36, e.g., is again required.

Alternatively, instead of moving the portable or stationary combustion system 2 to a desired dumping or disposal location, the operator may simply manipulate the radio controller 24 to raise and pivot the combustion chamber frame 8 relative to the base frame 6, and commence sliding of the relatively small ash, char, biochar, soot and/or small particles of unburnt debris 38, which accumulated in the plenum 42, as well as sliding of the relatively large ash, char, biochar, clinkers, soot, unburnt debris, etc., 36, which accumulated on the perforated plate 46 of the combustion chamber 40, toward the respective discharge outlets 64, 66 to empty both the plenum 42 and the combustion chamber 40. At the same time or before raising and pivoting the combustion chamber frame 8 relative to the base frame 6, the second (end) ceramic member 48 is moved vertically upward, via the radio controller 24, to open the discharge outlets 64, 66 of both the plenum 42 and the combustion chamber 40 and facilitate discharge of the accumulated ash, char, biochar, clinkers, soot, unburnt debris, etc., 36, 38 through both of those discharge outlets 64, 66. The discharged/dumped ash, char, biochar, clinkers, soot, unburnt debris, etc., 36, 38 can then be suitably quenched and cooled, with a heat conductive medium, such as water for example, in order to completely extinguish any embers or other material which is still burning. Thereafter, this completely extinguished material can then be picked up and removed, by conventional loading equipment, and transported to a suitable site for discharge into the soil or a suitable dumping or disposal location or facility.

It is to be appreciated that the heat conductive medium, e.g., water, may have one or more conventional additive(s) or nutrient(s) added thereto. For example, the additive may be a fertilizer or a pellet binder. In some embodiments, fertilizer may be added to the heat conductive medium or added or mixed with the ash, char, biochar, clinkers, soot, unburnt debris, etc., 36, 38 as the same is discharged from the portable or stationary combustion system 2 so as to provide the equivalence of approximately 200 lbs/acre of Nitrogen in the heat conductive medium so that the C:N ratio may decrease. Alternatively, fresh logging slash, i.e., fine (<¼") needles and twigs, may be mixed with the ash, char, biochar, clinkers, soot, unburnt debris, etc., 36, 38 as the same is discharged from the portable or stationary combustion system 2. In further embodiments, a nutrient mixer of Nitrogen, Phosphorous, Potassium, and/or the like may be added to the biochar product. The additives may be used in varying proportions in order to provide customized enrichment of the soil, dependent upon the particular application.

Figure 8:
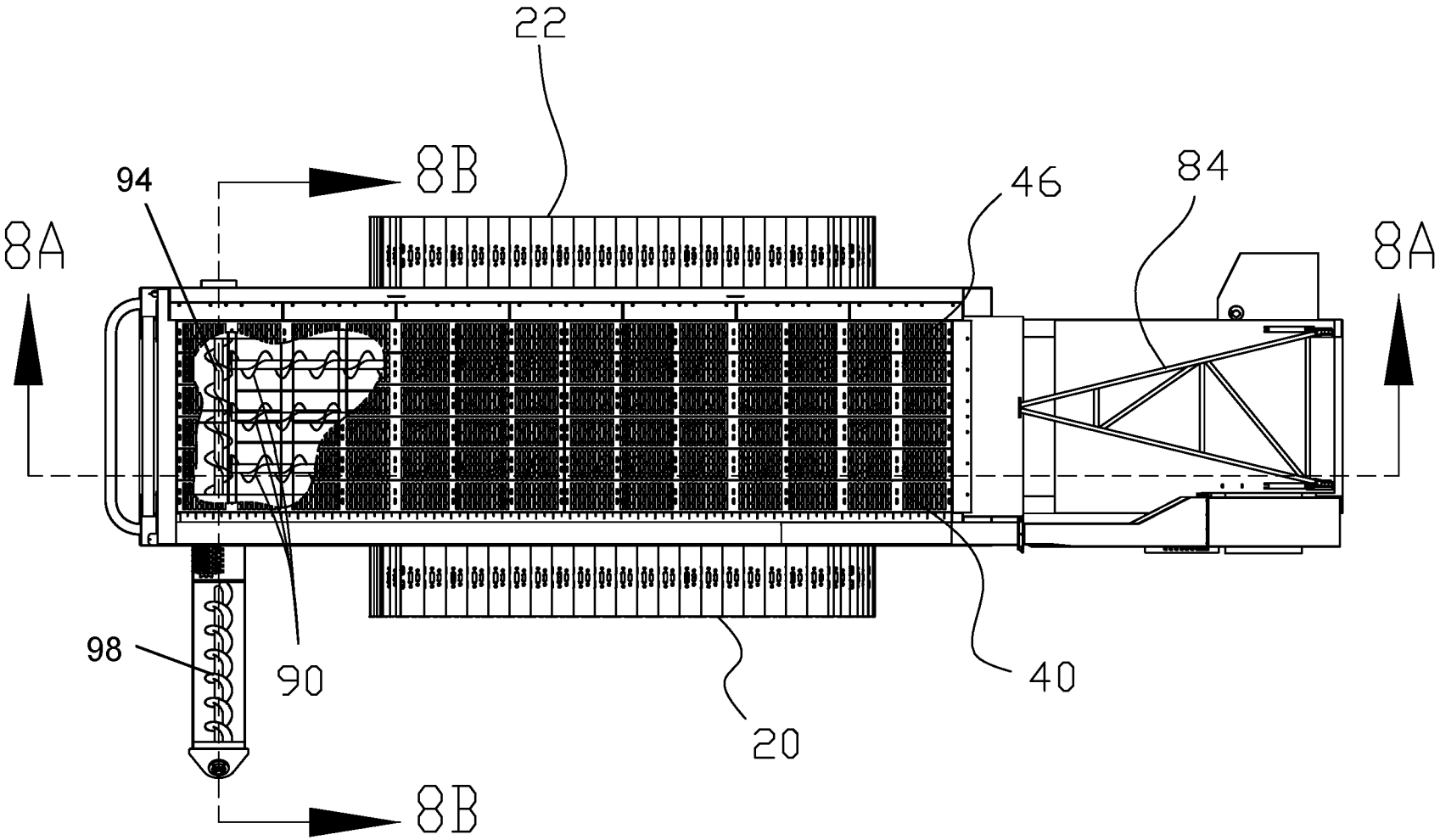
FIG. 8 is a diagrammatic top plan view of a second embodiment of the portable combustion system.
Figure 8A:
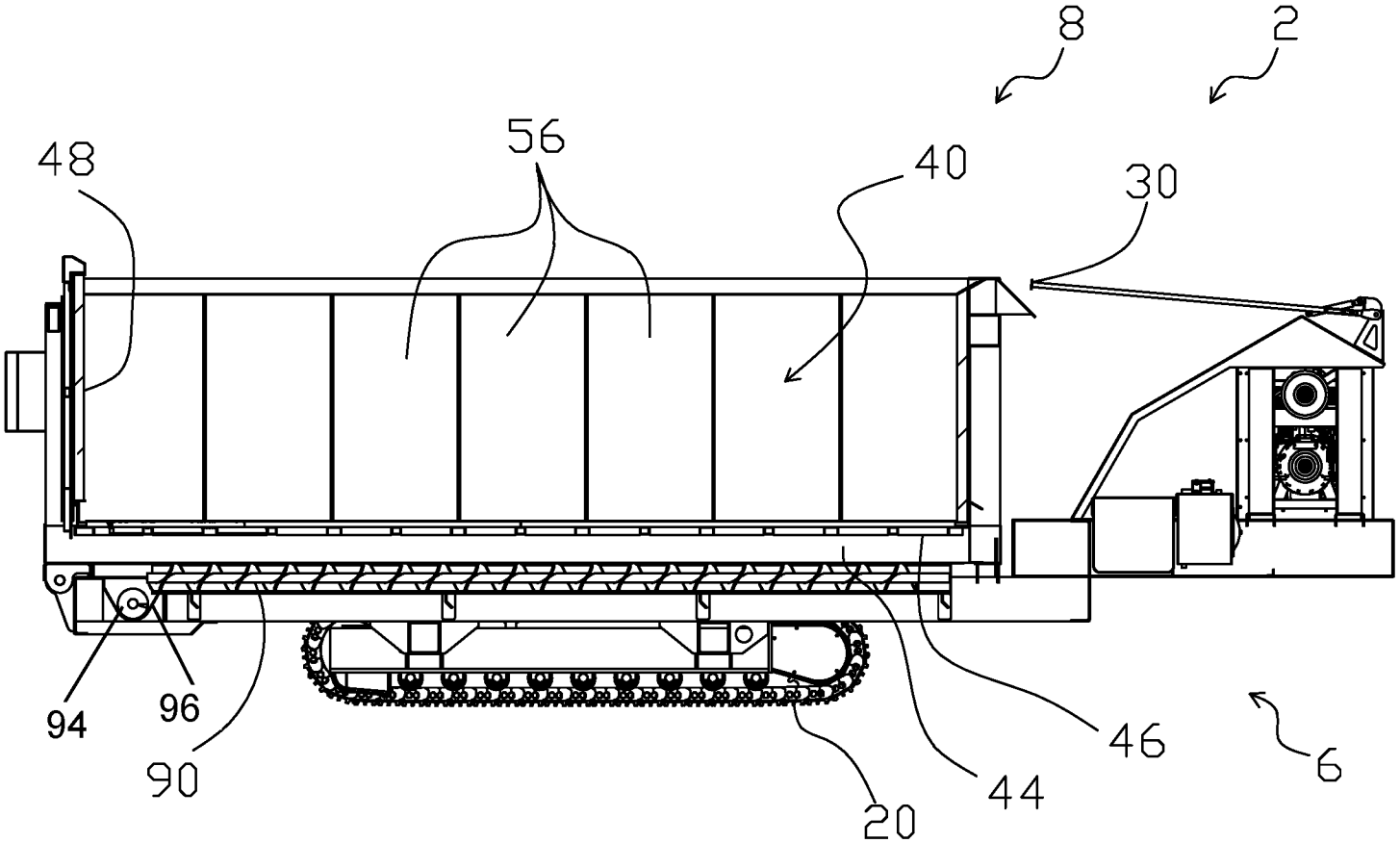
FIG. 8A is a diagrammatic cross-sectional view taken along section line 8A-8A of FIG. 8.
Figure 8B:
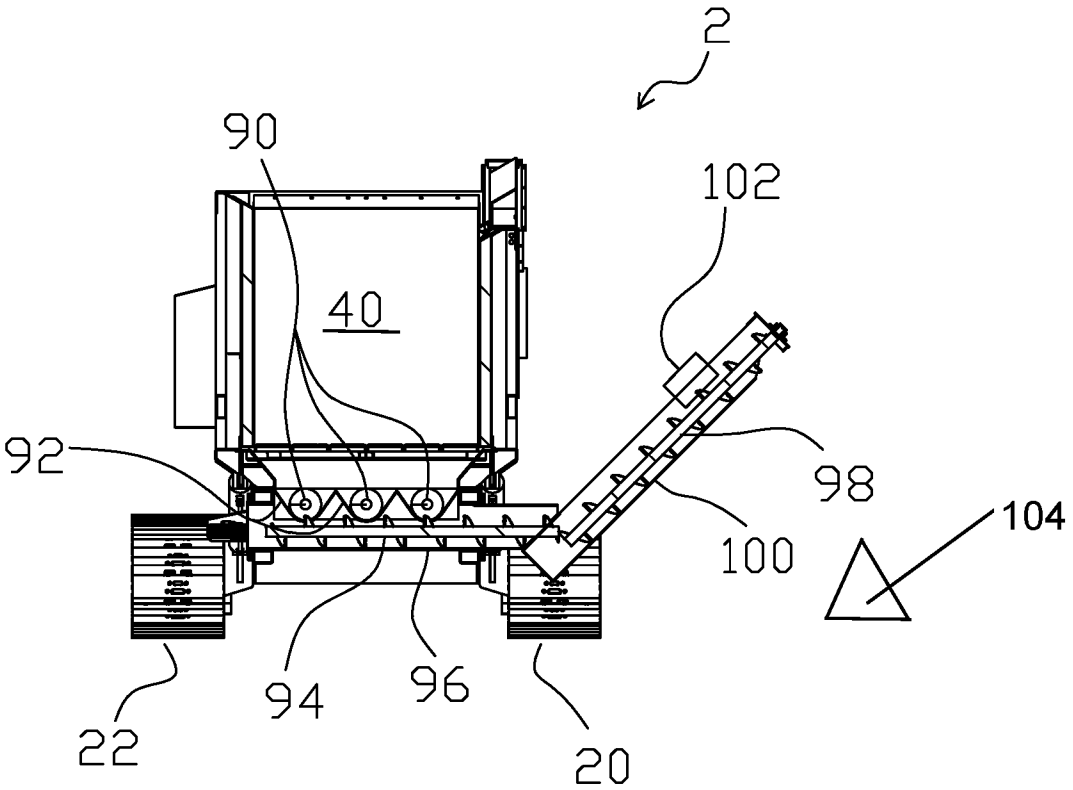
FIG. 8B is a diagrammatic cross-sectional view taken along section line 8B-8B of FIG. 8.
Figure 9:
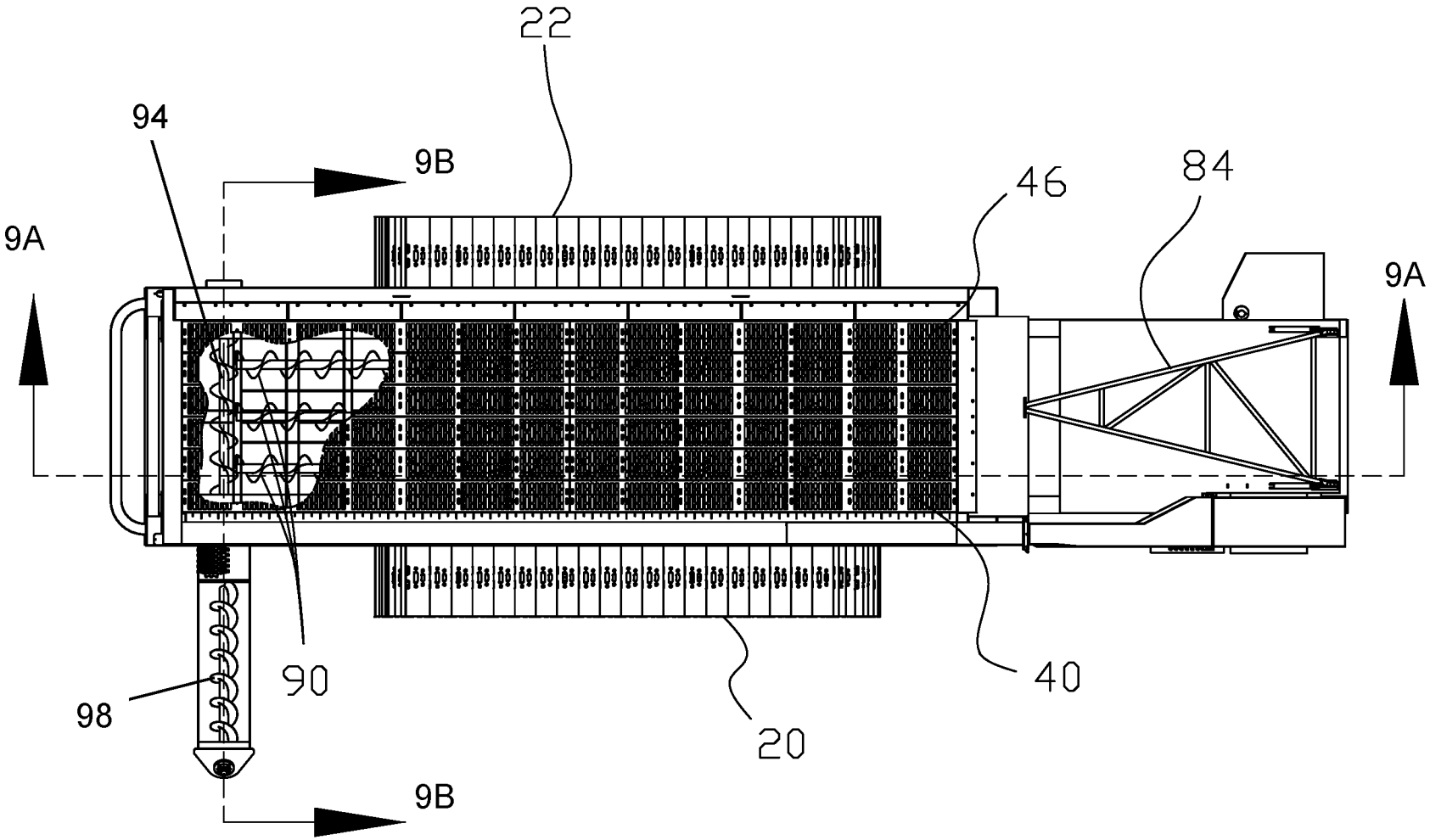
FIG. 9 is a diagrammatic top plan view of a third embodiment of the portable combustion system.
Figure 9A:
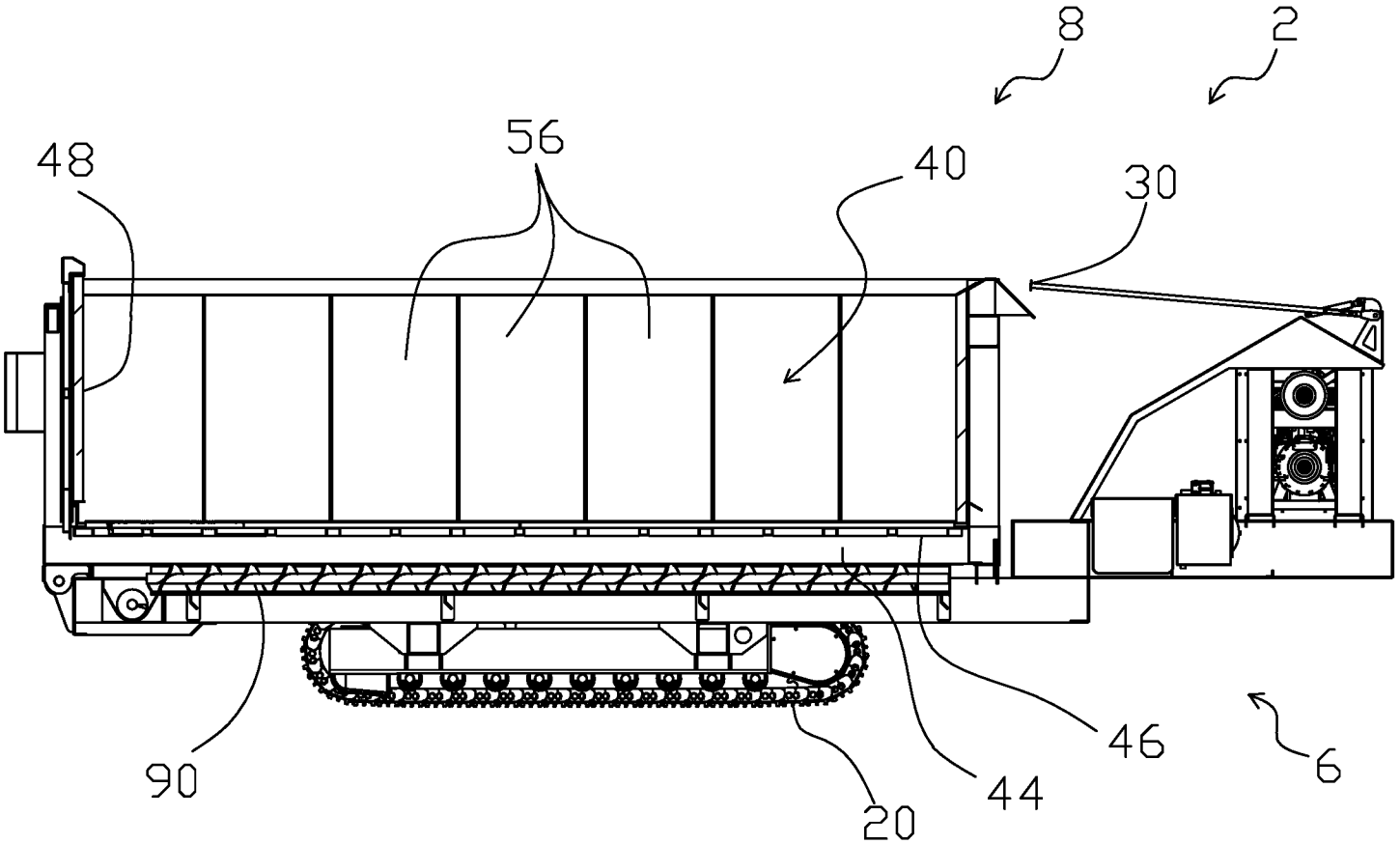
FIG. 9A is a diagrammatic sectional view taken along section line 9A-9A of FIG. 9.
Figure 9B:
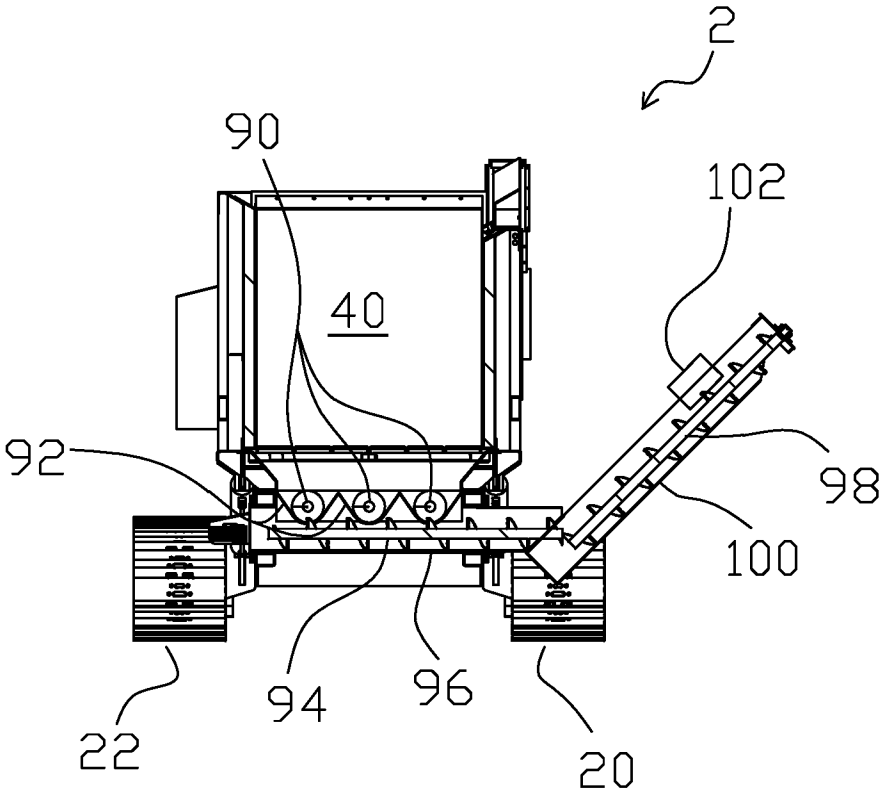
FIG. 9B is a diagrammatic cross-sectional view taken along section line 9B-9B of FIG. 9.

Turning now to FIGS. 8, 8A and 8B, a second embodiment of the present invention will now be described. As this embodiment is very similar to the previously discussed embodiment, only the differences between this new embodiment and the previous portable and stationary embodiments will be discussed in detail while identical elements will be given identical reference numerals.

The major difference between this embodiment in the previous embodiments relates to the plenum 42. According to this embodiment, a plurality of feed augers 90, e.g., three feed augers, are accommodated side-by-side and adjacent one another within the plenum 42. The bottom plate 44 of the plenum 42, according to this embodiment, is shaped to form three respective troughs 92 (see FIG. 8B), which each accommodate a respective one of the feed augers 90, and each trough 92 is designed to channel/direct the fine ash, char, biochar, and soot and/or small particles of unburnt debris 38, that pass through the plurality of openings, holes or apertures in the perforate plate 46, toward one of the feed augers 90 for conveyance toward the second end of the portable or stationary combustion system 2. As generally shown, each one of the feed augers 90 is located between the perforate plate 46 and the base plate 44 and extends parallel to one another and the perforate plate 46.

As best shown in FIG. 8, a collection auger 94 is located adjacent and extends laterally across the second end of the portable or stationary combustion system 2, adjacent the hinge 10. The collection auger (or possibly a collection conveyor) 94 is located vertically below a discharge end of each of the plurality of feed augers 90 so that the conveyed fine ash, char, biochar, soot and/or small particles of unburnt debris 38 is transferred and deposited into the collection auger 94 for conveyance of the same laterally of the portable or stationary combustion system 2. The collection auger 94 is accommodated within a housing 96 which is open at the top to facilitate receiving the conveyed fine ash, char, biochar, soot and/or small particles of unburnt debris 38 from the plurality of feed augers 90. The collection auger 94 then conveys the received fine ash, char, biochar, soot and/or small particles of unburnt debris 38, from the plurality of feed augers 90, laterally toward the first lateral side of the portable or stationary combustion system 2 for transfer to a discharge auger or a discharge conveyor 98. An inlet end of the discharge auger or discharge conveyor 98 is located vertically below a discharge end of the collection auger 94 to facilitate receiving the fine ash, char, biochar and soot and/or small particles of unburnt debris 38 conveyed by the collection auger 94. The discharge auger or discharge conveyor 98 may be accommodated within a housing 100 which is partially open to facilitate receiving the conveyed fine ash, char, biochar, soot and/or small particles of unburnt debris 38 from the collection auger 94. The discharge auger or discharge conveyor 98 then conveys the transferred fine ash, char, biochar, soot and/or small particles of unburnt debris 38 upwardly, e.g., at an angle of about 20-70 degrees for example, and away from the portable or stationary combustion system 2.

A magnetic 102 may be located in close proximity to and may surround the entire periphery or circumference of the discharge auger or discharge conveyor 98. This magnetic 102 is arranged to facilitate removing, via magnetic attraction, any metallic particle(s) and/or other metallic objects which are contained within the conveyed fine ash, char, biochar, soot and/or small particles of unburnt debris 38. The magnetic 102 is preferably powerful enough and/or located sufficiently close to the conveyed fine ash, char, biochar, soot and/or small particles of unburnt debris 38 so as to remove substantially 100% of the metal contained therein prior to the fine ash, char, biochar, soot and/or small particles of unburnt debris 38 being discharged, from a discharge end of the discharge auger or discharge conveyor 98 into a collection pile 104.

According to this embodiment, each one of the feed augers 90, the collection auger 94, and the discharge auger or discharge conveyor 98 is hydraulically driven in a conveying rotational direction in order to convey the fine ash, char, biochar, soot and/or small particles of unburnt debris 38, which passes through the plenum 42, into the collection pile 104 of fine ash, char, biochar, soot and/or small particles of unburnt debris. As shown, all of the feed augers 90 are accommodated within the plenum 42 and thus pivot and move with the combustion chamber frame 8 when the combustion chamber frame 8 pivots with respect to the base frame 6 into the discharge or dumping position. However, both the collection auger 94 and the discharge auger or discharge conveyor 98 are supported by the base frame 6 and thus do not pivot with the combustion chamber frame 8 when that frame is lifted and pivots with respect to the base frame 6.

It is to be appreciated that, if desired, the base plate 44, the plurality of feed augers 90 and the feed auger hydraulic motors (not shown in detail) can be releasably fastened to the combustion chamber frame 8 by a plurality of conventional fasteners (not shown in detail), e.g., bolts, to assist with maintenance thereof. Typically, the base plate 44, the plurality of feed augers 90 and the feed auger hydraulic motors are normally fastened to the combustion chamber frame 8 so that these components all move and pivot along with the combustion chamber frame 8 when the combustion chamber frame 8 is moved into the discharge or dumping position. However, when the conventional fasteners are removed, the base plate 44, the plurality of feed augers 90 and the feed auger hydraulic motors are disconnected from the combustion chamber frame 8 and remain supported by the base frame 6. Accordingly, those components do not move or pivot along with the combustion chamber frame 8 when the combustion chamber frame 8 is moved into the discharge position. As a result, the operator has direct access to both the bottom surface of the perforate plate 46 as well as the plurality of feed augers 90 and the respective troughs 92 to facilitate any repair, servicing or replacement of components when the combustion chamber frame 8 is moved into the discharge position.

Turning now to FIGS. 9, 9A, 9B and 10, a third embodiment of the present invention will now be described. As this third embodiment is very similar to the second embodiment, only the differences between the third embodiment and the second embodiment will be discussed in detail while identical elements will be given identical reference numerals.

The major difference between the third embodiment and the second embodiment relates to arrangement of the plenum 42. According to this embodiment, similar to the second embodiment, a plurality of feed augers 90, e.g., three feed augers, are accommodated side-by-side adjacent one another in the plenum 42. In addition, the plenum 42 is shaped to form respective troughs 92, which each accommodate a respective one of the feed augers 90, to channel/direct the ash, char, biochar, clinkers, soot, unburnt debris, etc., 38, that pass through the plurality of openings, holes or apertures in the perforate plate 46, toward one of the feed augers 90 for conveyance toward the second end of the portable or stationary combustion system 2. As generally shown, each one of the feed augers 90 is located between the perforate plate 46 and the base plate 44 of the plenum 42 such that the feed augers 90 extends parallel to one another and the perforate plate 46.

As with the previous embodiment, the collection auger 94 is located vertically below the discharge end of each of the plurality of feed augers 90 so that the conveyed ash, char, biochar, clinkers, soot, unburnt debris, etc., 36 is deposited from the feed augers 90 onto the collection auger 94 for conveyance of the same laterally. The collection auger 94 is accommodated within a housing 96 which is open at the top to facilitate receiving the conveyed ash, char, biochar, clinkers, soot, unburnt debris, etc., 36. The collection auger 94 then conveys the received ash, char, biochar, clinkers, soot, unburnt debris, etc., 38, from the plurality of feed augers 90, laterally toward the first lateral side of the portable or stationary combustion system 2 for transfer to a discharge auger or discharge conveyor 98.

An inlet end of the discharge auger or discharge conveyor 98 is located vertically below a discharge end of the collection auger 94 to facilitate receiving the ash, char, biochar, clinkers, soot, unburnt debris, etc., 36 conveyed by the collection auger 94. The discharge auger or discharge conveyor 98 may be accommodated within a housing 100 which is partially open at the inlet end thereof to facilitate receiving the conveyed ash, char, biochar, clinkers, soot, unburnt debris, etc., 38 from the collection auger 94. The discharge auger or discharge conveyor 98 then conveys the transferred ash, char, biochar, clinkers, soot, unburnt debris, etc., 38 upwardly, e.g., at an angle of about 20-70 degrees, and away from the portable or stationary combustion system 2.

A magnetic 102 may be located in close proximity to opening provided in the housing 100, and may possibly surround the entire periphery or circumference of the discharge auger or discharge conveyor 98. This magnetic 102 is arranged to facilitate attracting and removing, via magnetic attraction, any metallic particle(s) and/or other metallic objects which are contained within the conveyed ash, char, biochar, clinkers, soot, unburnt debris, etc., 38 as such metallic particle(s) and/or object(s) is conveyed past the magnetic 102. The magnetic 102 is preferably powerful enough and/or located sufficiently close to the conveyed ash, char, biochar, clinkers, soot, unburnt debris, etc., 38 so as to remove substantially 100% of the ferrous metal contained therein prior to the ash, char, biochar, clinkers, soot, unburnt debris, etc., 36 being discharged, from a discharge end of the discharge auger or discharge conveyor 98, into a collection area or pile 104.

It is to be appreciated that the discharged/dumped ash, char, biochar, clinkers, soot, unburnt debris, etc., 36, upon being discharged into the collection area or pile 104, can then be suitably quenched and cooled with a heat conductive medium, such as water for example, in order to completely extinguish any embers or other material which is still burning. The ash, char, biochar, clinkers, soot, unburnt debris, etc., 36 may also be discharged from the discharge auger or discharge conveyor 98 directly into a tank or container of water in order to ensure complete quenching of the ash, char, biochar, clinkers, soot, unburnt debris, etc., 36. The quenched ash, char, biochar, clinkers, soot, unburnt debris, etc., 38 can then be removed for the tank or container of water and possibly dried. Thereafter, the completely extinguished material can then be picked up and removed, by conventional loading equipment, and transported to a suitable site for discharge into the soil or delivery to a suitable dumping or disposal location or facility.

It is to be appreciated that the heat conductive medium, e.g., water, may have one or more conventional additive(s) or nutrient(s) added thereto. For example, the additive may be a fertilizer or a pellet binder. In some embodiments, fertilizer may be added to the heat conductive medium or added or mixed with the ash, char, biochar, clinkers, soot, unburnt debris, etc., 36 as the same is discharged from the portable or stationary combustion system 2 so as to provide the equivalence of approximately 200 lbs/acre of Nitrogen in the heat conductive medium so that the C:N ratio may decrease. Alternatively, fresh logging slash, i.e., fine (<¼") needles and twigs, may be mixed with the ash, char, biochar, clinkers, soot, unburnt debris, etc., 36 as the same is discharged from the portable or stationary combustion system 2. In further embodiments, a nutrient mixer of Nitrogen, Phosphorous, Potassium, and/or the like may be added to the biochar product. The additives may be used in varying proportions in order to provide customized enrichment of the soil, dependent upon the particular application.

Figure 10:
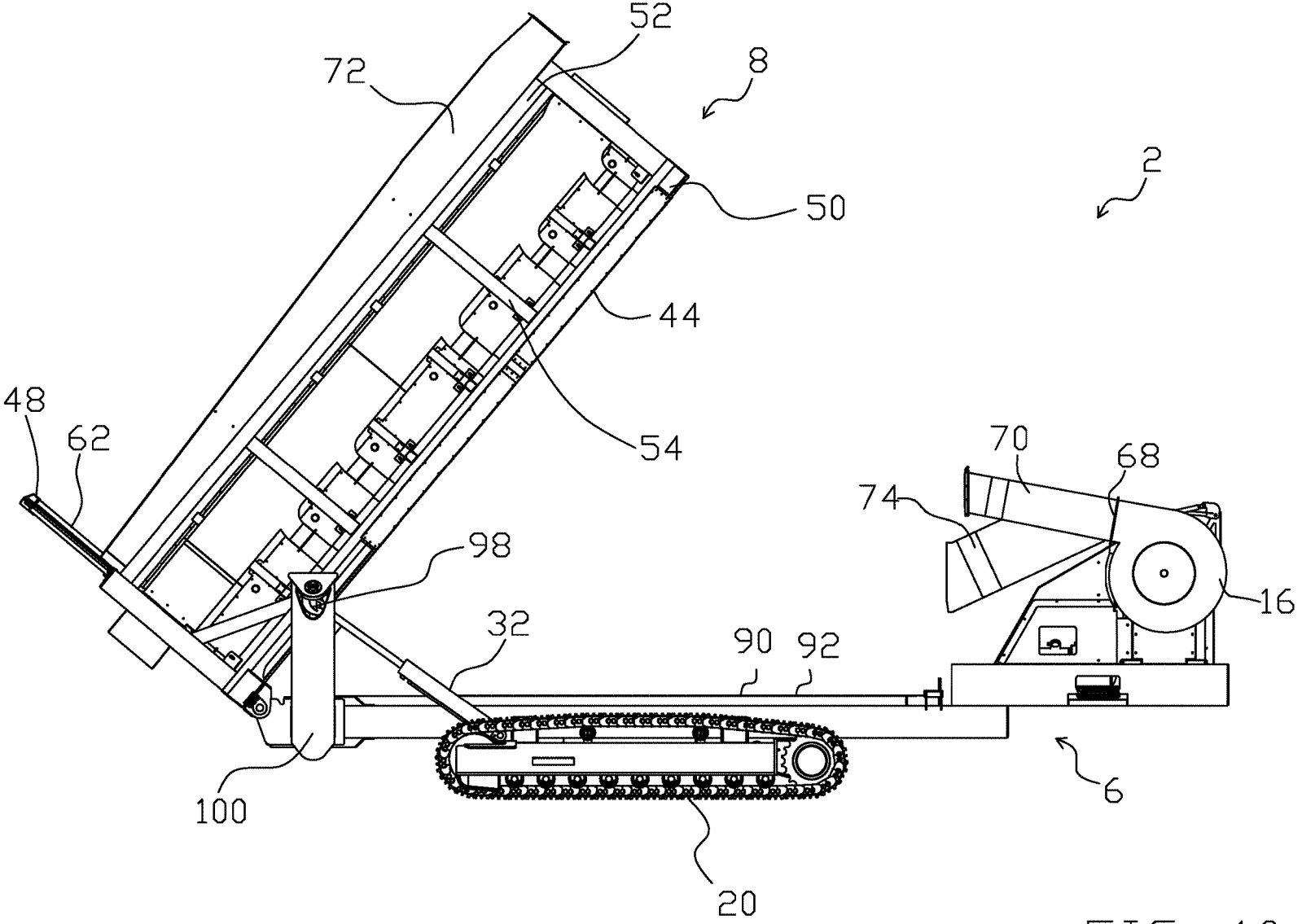
FIG. 10 is a diagrammatic side elevational view of the portable combustion system of FIG. 9 with the combustion chamber frame pivoted into a discharge positioned for discharging the accumulated ash, char, biochar, clinkers, soot, unburnt debris, etc., from the plenum and/or the combustion chamber, depending upon the position of slidable gate.

According to this embodiment, however, the plenum 42 is separatable into two distinct sections. The first section comprises the plurality of feed augers 90, the respective troughs 92 and the base plate 44 which are all directly supported by the base frame 6 while the second portion comprises the perforate plate 46 which forms both the bottom surface of the combustion chamber frame 8 as well as the top surface of the plenum 42. As with all of the embodiments, the perforate plate 46 is supported by the combustion chamber frame 8. Since the perforate plate 46 is part of the combustion chamber frame 8 while the plurality of feed augers 90, the respective troughs 92, the base plate 44 and the feed auger hydraulic motors are all part of the base frame 6, only the perforate plate 46 is moved and pivoted with the combustion chamber frame 8, when the combustion chamber frame 8 is raised or pivoted with respect to the base frame 6, while the plurality of feed augers 90, the respective troughs 92, the base plate 44 and the feed auger hydraulic motors do not pivot and remain supported by the base frame 6. As a result of this arrangement, when the combustion chamber frame 8 is pivoted into its raised position as shown in FIG. 10, the plenum is separated and opened so that the operator has direct access to both the bottom surface of the perforate plate 46 as well as the plurality of feed augers 90, the respective troughs 92 and the feed auger hydraulic motors to facilitate any repair, servicing or replacement of components.

It is to be appreciated that the discharge augers or conveyers 90, 94, 98 permit the portable or stationary combustion system 2 to be operated for a longer period of time before removal of the ash, char, biochar, clinkers, soot, unburnt debris, etc., 36 from the combustion chamber is necessary or required. In addition, the implementation of augers or conveyors 90, 94, 98 typically allow the plurality of openings, holes or apertures, formed in the perforate plate 46, to be somewhat larger in size thereby permitting somewhat larger ash, char, biochar, soot and small particles to pass therethrough and be conveyed along the plenum 42 toward the second end of the portable or stationary combustion system 2.

According to the present disclosure, each of the portable or stationary combustion system 2 comprises only two distinct compartments or chambers. The first compartment or chamber is the combustion chamber 40, which receives the waste material 4 and facilitates burning thereof, while the second compartment or chamber comprises the plenum and the auger/conveyors, i.e., the plenum 42, the feed augers 90, the collection auger 94 and the discharge auger or discharge conveyor 98 which together all function to receive, collect and transport the relatively larger ash, char, biochar, soot and small particles to a collection area, e.g., a collection pile or a collection tank or container of water.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure not be limited by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

Wherefore, I claim:

1. A combustion system comprising:

a combustion chamber frame having a combustion chamber frame first end and a combustion chamber frame second end;

a base frame having a base frame first end and a base frame second end;

the combustion chamber frame second end being pivotably attached to the base frame second end;

the combustion chamber frame defining a combustion chamber;

a perforated plate forming a bottom surface of the combustion chamber, and the perforated plate having a plurality of openings formed therein;

the combustion chamber being open along at a top thereof to facilitate feeding of waste material into the combustion chamber;

at least one blower for supplying combustion air to the combustion chamber to assist with combustion of the waste material; and the at least one blower being coupled to an air manifold for supplying a first source of combustion air across the top of the combustion chamber and forming an air curtain across the open top during operation of the combustion system, and the at least one blower being coupled to an air supply duct for supplying a second source of combustion air through a bottom surface of the perforated plate and into the combustion chamber to assist with combustion of the waste material contained within the combustion chamber;

wherein a base plate is located below the perforated plate, a plenum is defined between the base plate and the perforated plate, and the plenum receives and distributes the second source of combustion air from the air supply duct through the plurality of openings formed in the perforated plate and into the combustion chamber.

2. The combustion system according to claim 1, wherein sidewalls of the combustion chamber are defined by a plurality of ceramic members, a first end ceramic member and a movable second end ceramic member, the movable second end ceramic member is located adjacent the base plate for normally closing one end of both the plenum and the combustion chamber, and the movable second end ceramic member is movable into a first open position to facilitate discharge of accumulated fine ash, char, biochar, soot and/or small particles from only the plenum, when the combustion chamber frame is pivoted into a discharge position, and the second end ceramic member is movable into a second open position to facilitate discharge of accumulated fine ash, char, biochar, soot and/or small particles from the plenum and discharge of accumulated ash, char, biochar, clinkers, soot, unburnt debris from the combustion chamber, when the combustion chamber frame is pivoted into the discharge position.

3. The combustion system according to claim 2, wherein the air supply duct is located adjacent rear surfaces of the plurality of ceramic members so that the second source of combustion air, which flows through the air supply duct, is preheated prior to the second source of combustion air flowing through the plurality of openings formed in the perforated plate and into the combustion chamber.

4. The combustion system according to claim 1, wherein a plurality of feed augers are accommodated within the plenum, and the base plate of the plenum is shaped to form a plurality of troughs, each one of the plurality troughs accommodates a respective one of the feed augers, and each respective trough directs fine ash, char, biochar, soot and/or particles of unburnt debris, which passes through the plurality of openings in the perforated plate, toward the respective feed auger for conveyance toward the second end of the combustion system;

a collection auger is located adjacent the second end of the combustion system, and the collection auger receives and conveys the conveyed fine ash, soot and/or particles of unburnt debris laterally toward a first lateral side of the combustion system to a discharge auger or conveyor; and the discharge auger or conveyor receives and conveys the fine ash, char, biochar, soot and/or particles of unburnt debris away from the combustion system to a collection area.

5. The combustion system according to claim 4, wherein the collection auger and the discharge auger are supported by the base frame;

the base plate and the plurality of feed augers are releasably connected to the combustion chamber frame so that the base plate and the plurality of feed augers normally pivot with the combustion chamber frame, when the first end of the combustion chamber frame is pivoted away from the first end of the base frame about the horizontal pivot into a discharge position, when the base plate and the plurality of feed augers are disconnected from the combustion chamber frame, the base plate and the plurality of feed augers remain stationary and do not pivot with the combustion chamber frame so that access to the plurality of feed augers and the troughs is provided, when the combustion chamber frame is pivoted away from the first end of the base frame about the horizontal pivot into the discharge position.

6. The combustion system according to claim 5, wherein sidewalls of the combustion chamber are defined by a plurality of ceramic members, a first end ceramic member and a movable second end ceramic member, the movable second end ceramic member is located adjacent the perforated plate for normally closing one end of the combustion chamber, and the movable second end ceramic member is movable into an open position to facilitate discharge of accumulated ash, char, biochar, clinkers, soot, unburnt debris from the combustion chamber when the combustion chamber frame is pivoted into the discharge position.

7. The combustion system according to claim 4, wherein the plurality of feed augers, the troughs, the collection auger and the discharge auger or conveyor are all supported by the base frame, and when the combustion chamber frame is in a lower position, the perforated plate sealing engages with the base plate to define the plenum, but when the combustion chamber frame is pivoted away from the first end of the base frame about the horizontal pivot into the discharge position, the perforated plate separates away from the base plate and the plurality of augers to provide access to the plurality of augers and the bottom surface of the perforated plate.

8. The combustion system according to claim 7, wherein sidewalls of the combustion chamber are defined by a plurality of ceramic members, a first end ceramic member and a movable second end ceramic member, the movable second end ceramic member is located adjacent the perforated plate for normally closing one end of the combustion chamber, and the movable second end ceramic member is movable into an open position to facilitate discharge of accumulated ash, char, biochar, clinkers, soot, unburnt debris from the combustion chamber when the combustion chamber frame is pivoted into the discharge position.

9. The combustion system according to claim 1, wherein the base frame is supported by a drive assembly which facilitates movement of the combustion system, and the drive assembly comprises one of wheels or a pair of drivable tracks which facilitate movement of the combustion system to a desired location.

10. The combustion system according to claim 9, wherein a control panel is affixed to the combustion system, and the control panel controls operation of an engine, a pump and a supply of hydraulic pressure to a drive assembly in order to control turning and forward and reverse travel of the combustion system, and a handheld remote radio controller communicates wirelessly with the control panel, and the radio controller is also equipped with a display which facilitates displaying images received from a viewing device.

11. The combustion system according to claim 1, wherein the base frame is supported by a stationary support assembly which facilitates supporting of the combustion system in a stationary position on a desired surface.

12. The combustion system according to claim 1, wherein combustion system has a viewing device which permits viewing of the combustion chamber by an operator, and the viewing device is attached to a stand which is movable from a storage position to a deployed position, and vice versa, and the viewing device, when in the deployed position, facilitates viewing of the combustion chamber.

13. The combustion system according to claim 1, wherein the perforated plate is fabricated from metal and has a thickness of between ⅜ and 4 inches, and the plurality of openings formed in the perforated plate facilitate fine ash, char, biochar, soot and other small debris passing through the plurality of openings formed in the perforated plate and collecting on the base plate as well as passage of the second source of combustion air through the plurality of openings into the combustion chamber.

14. The combustion system according to claim 1, wherein at least a portion of an internal cross sectional area the air manifold tapers to a smaller cross sectional area, from a first end thereof toward a second end thereof where the air manifold terminates, and at least a portion of an internal cross sectional area the air supply duct tapers to a smaller cross sectional area, from a first end thereof toward a second end thereof where the air supply duct terminates.

15. The combustion system according to claim 1, wherein at least one hydraulic frame piston/cylinder couples the combustion chamber frame to the base frame to facilitate lifting of a first end of the combustion chamber frame away from a first end of the base frame and pivoting of the combustion chamber frame, about the horizontal hinge, with respect to the base frame, into a discharge position for discharging accumulated ash, char, biochar, clinkers, soot, unburnt debris.

16. The combustion system according to claim 1, wherein either:

a Y-coupling couples the at least one blower to both the air manifold and the air supply duct, and an adjustable damper is accommodated within the Y-coupling to control distribution of the combustion air which is supplied by the at least one blower to the air manifold and the air supply duct, and a plurality of air feed ducts are provided along the air supply duct and communicate with the plenum to facilitate supplying the second source of combustion air to the plenum; or the at least one blower comprises first and second blowers, the first blower is coupled to the air manifold while the second blower is coupled to the air supply duct, and a plurality of air feed ducts are provided along the air supply duct and communicate with the plenum to facilitate supplying the second source of combustion air to the plenum.

17. The combustion system according to claim 1, wherein at least one nozzle is installed within the combustion chamber and connected to a fuel source, an igniter is associated with the at least one nozzle to assist with generating a spark and initiating a flame, when fuel is supplied from the fuel source to the at least one nozzle, thereby ignite the waste material contained within the combustion chamber.

18. The combustion system according to claim 1, wherein at least one engine is supported on the base frame, the at least one engine either directly or hydraulically drives the at least one blower for generating the first and second sources of combustion air, and the at least one engine also drives a hydraulic pump for generating a source of hydraulic pressure for controlling operation of the combustion system.

19. A method of combusting waste material in a combustion system, the method comprising:

providing a combustion chamber frame;

providing a base frame;

pivotably attaching one end of the combustion chamber frame to one end of the base frame;

defining a combustion chamber on the combustion chamber frame;

using a perforated plate to form a bottom surface of the combustion chamber, and forming plurality of openings in the perforated plate;

leaving a top of the combustion chamber open to facilitate feeding of the waste material into the combustion chamber;

supplying combustion air to the combustion chamber, via at least one blower, to assist with combustion of the waste material, and dividing the combustion air into first and second sources of combustion air;

supplying the first source of combustion air, via an air manifold, across the top of the combustion chamber to form an air curtain; and supplying the second source of combustion air, via a plenum, through the plurality of openings, formed in the perforated plate, and into the combustion chamber, via an air supply duct, to assist with combustion of the waste material contained within the combustion chamber;

wherein the plenum is defined between a base plate, located below the perforated plate, and the perforated plate.

* * * * *